US010663926B2

(12) United States Patent
Oh

(10) Patent No.: US 10,663,926 B2
(45) Date of Patent: May 26, 2020

(54) ELECTRONIC TIMEPIECE

(71) Applicant: Seiko Epson Corporation, Tokyo (JP)

(72) Inventor: Jaekwan Oh, Shiojiri (JP)

(73) Assignee: Seiko Epson Corporation (JP)

( * ) Notice: Subject to any disclaimer, the term of this patent is extended or adjusted under 35 U.S.C. 154(b) by 153 days.

(21) Appl. No.: 15/910,528

(22) Filed: Mar. 2, 2018

(65) Prior Publication Data

US 2018/0253063 A1 Sep. 6, 2018

(30) Foreign Application Priority Data

Mar. 6, 2017 (JP) ..... 2017-041891

(51) Int. Cl.
*G04G 5/00* (2013.01)
*G04G 9/00* (2006.01)
*G04G 21/00* (2010.01)

(52) U.S. Cl.
CPC ..... *G04G 5/00* (2013.01); *G04G 9/0076* (2013.01); *G04G 21/00* (2013.01)

(58) Field of Classification Search
CPC ..... G04G 5/00; G04G 9/0076; G04G 21/00
See application file for complete search history.

(56) References Cited

U.S. PATENT DOCUMENTS 7,821,875 B2 * 10/2010 Punkka ..... G04G 9/0076 368/21
2011/0051559 A1 3/2011 Oh
2011/0280108 A1 11/2011 Honda
2016/0209813 A1 7/2016 Hasegawa

FOREIGN PATENT DOCUMENTS

JP 2011-048777 A 3/2011
JP 2011-237314 A 11/2011
JP 2016-133337 A 7/2016

* cited by examiner

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

An electronic timepiece for enabling the user to easily change daylight saving time implementation rules includes a memory, a location information setting device, a time display, a daylight saving time switch, and a controller. The memory is configured to store location information, time zones, and daylight saving time rules. The location information setting device is configured to set location information. The time display is configured to display time based on the time zone and daylight saving time rule corresponding to the location information set by the location information setting device. The daylight saving time switch is configured to turn a daylight saving time mode on (implemented) and off (not implemented). The controller is configured to correct daylight saving time rules based on the timing when the daylight saving time switch was operated to change the daylight saving time mode on or off.

9 Claims, 23 Drawing Sheets

| NORTHWEST CORNER COORDINATES (LATITUDE AND LONGITUDE) | SOUTHEAST CORNER COORDINATES (LATITUDE AND LONGITUDE) | TIME DIFFERENCE OF TIME ZONE | DST NUMBER |
|---|---|---|---|
| E080 , N50 | E081 , N51 | + 6 | 0 |
| E000 , N50 | E001 , N51 | + 0 | 1 |
| W080 , N50 | W081 , N51 | − 5 | 2 |
| ⋮ | ⋮ | ⋮ | ⋮ |

81

FIG. 4

| DST NUMBER | DST START | DST END | DST TIME DIFFERENCE |
|---|---|---|---|
| 0 | NONE | NONE | + 0 |
| 1 | 01:00 first Sunday in March | 02:00 last Sunday in October | + 1 |
| 2 | 02:00 second Sunday in March | 02:00 first Sunday in November | + 1 |
| ・・・ | ・・・ | ・・・ | ・・・ |
| 15 | 02:00 first Sunday in March | 02:00 first Sunday in November | + 1 |
| ・<br>・<br>・<br>・ | ・<br>・<br>・<br>・ | ・<br>・<br>・<br>・ | ・<br>・<br>・<br>・ |

82

FIG. 5

| NORTHWEST CORNER COORDINATES (LATITUDE AND LONGITUDE) | SOUTHEAST CORNER COORDINATES (LATITUDE AND LONGITUDE) | TIME DIFFERENCE OF TIME ZONE | CORRECTED DST NUMBER |
|---|---|---|---|
| E000 , N50 | E001 , N51 | +0 | 15 |
| ⋮ | ⋮ | ⋮ | ⋮ |

83

FIG. 6

| CITY NUMBER | CITY NAME | TIME ZONE | DST NUMBER |
|---|---|---|---|
| 0 | LONDON | +0 | 1 |
| 1 | TOKYO | +9 | 0 |
| 2 | NEW YORK | −5 | 2 |
| ⋮ | ⋮ | ⋮ | ⋮ |

81B

FIG. 14

| DST NUMBER | DST START | DST END | DST TIME DIFFERENCE |
|---|---|---|---|
| 0 | NONE | NONE | + 0 |
| 1 | 01:00 first Sunday in March | 02:00 last Sunday in October | + 1 |
| 2 | 02:00 second Sunday in March | 02:00 first Sunday in November | + 1 |
| ⋮ | ⋮ | ⋮ | ⋮ |

82B

FIG. 15

| CITY NUMBER | TIME ZONE | CORRECTED DST NUMBER |
|---|---|---|
| 0 | +0 | 15 |
| ⋮ | ⋮ | ⋮ |

83B

FIG. 16

ELECTRONIC TIMEPIECE

BACKGROUND

1. Technical Field

The present invention relates to an electronic timepiece capable of displaying daylight saving time (summer time).

2. Related Art

Electronic timepieces having memory storing time zones and daylight saving time rules for implementing daylight saving time, and the function of a world clock that selects the time zone and daylight saving time rules based on acquired location information, and displays the correct local time in the current location, are known from the literature. See, for example, JP-A-2016-133337.

The location information in such an electronic timepiece uses the name of a city selected by manipulating the crown, for example, or by receiving satellite signals transmitted from GPS (Global Positioning System) satellites and calculating the location based on the received signals.

Such electronic timepieces can determine, based on daylight saving time rules applicable to a particular time zone, if daylight saving time is currently in effect in the time zone selected based on the location information, and can automatically change the displayed time if daylight saving time is in effect.

However, factors such as whether or not daylight saving time is used, and when daylight saving time starts and ends, may change for political, economic, and other reasons. When the timepiece moves with the user, such as in the case of a wristwatch, and the daylight saving time rules applied in the country or region visited by the user have changed, it is desirable for the electronic timepiece to be able to automatically change the daylight saving time rules applied.

To meet this need, the electronic timepiece described in JP-A-2016-133337 enables the user to correct the starting month, starting time, starting week, starting day, starting date, ending month, ending time, ending week, ending day, ending date, or other attribute of the daylight saving time rules by manipulating an operating unit, such as the crown and four buttons, and confirming the information indicated by the multiple hands moving in response to operation of the operating unit.

However, to adjust when daylight saving time starts and ends, the electronic timepiece described in JP-A-2016-133337 requires setting each rule attribute one by one, requiring a complicated operation that is difficult to intuitively understand. The problem of enabling easily setting the daylight saving time rules thus remains.

SUMMARY

An objective of the present invention is to provide an electronic timepiece that enables the user to easily set daylight saving time rules.

An electronic timepiece according to the invention includes: memory storing location information, time zones corresponding to the location information, and daylight saving time rules corresponding to the location information; a location information setting device configured to set the location information; a time display configured to display time based on the time zone and the daylight saving time rule corresponding to the location information set by the location information setting device; a daylight saving time switch configured to switch between a daylight saving time on state and a daylight saving time off state; and a controller configured to correct the daylight saving time rule based on the timing when the daylight saving time switch was operated to switch between the daylight saving time on and off states.

The electronic timepiece according to this aspect of the invention has a daylight saving time switch for switching between a daylight saving time on (implemented) state and a daylight saving time off (not implemented) state, and corrects a daylight saving time rule based on the timing when the daylight saving time switch was operated to turn daylight saving time on or off. As a result, the user of the electronic timepiece can easily change daylight saving time rules by simply operating the daylight saving time switch appropriately to when daylight saving time starts and ends.

Preferably in an electronic timepiece according to the invention, the daylight saving time rule includes data indicating the start time and end time of the daylight saving time implementation period. The controller, when the daylight saving time state is changed from off to on by the daylight saving time switch, changes the start time of the daylight saving time implementation period based on the timing of daylight saving time switch operation if the timing of daylight saving time switch operation is within a specific period from the start time of the existing daylight saving time rule. When the daylight saving time state is changed from on to off by the daylight saving time switch, the controller changes the end time data of the daylight saving time implementation period based on the timing of daylight saving time switch operation if the timing of daylight saving time switch operation is within a specific period from the end time of the existing daylight saving time rule.

This aspect of the invention changes the start time of the daylight saving time rule according to the timing of daylight saving time switch operation to change the daylight saving time mode from off to on if the timing is within a specific period from the start time of the existing daylight saving time rule. Because the start time data is changed only when the likelihood is high that the daylight saving time switch was operated to change when daylight saving time starts, the start time can be correctly adjusted.

This aspect of the invention changes the end time of the daylight saving time rule according to the timing of daylight saving time switch operation to change the daylight saving time mode from on to off if the timing is within a specific period from the end time of the existing daylight saving time rule. Because the end time data is changed only when the likelihood is high that the daylight saving time switch was operated to change when daylight saving time ends, the end time can be correctly adjusted.

Preferably in an electronic timepiece according to the invention, the controller, when the start time or end time of the daylight saving time rule to be corrected is defined by the month, week, day of the week, and time, changes the month and week to the month and week of the timing when the daylight saving time switch was operation, and does not change the day and time.

The start time and end time of daylight saving time rules is often defined by the month, week, day, and time, and when such rules are changed, often only the month or week is changed, and the day and time remain the same. Therefore, by identifying the month and week when the daylight saving time switch is operated, and setting the day and time the same as before (in the existing rule), the daylight saving time rule can be easily changed.

Furthermore, because the timing of daylight saving time switch operation does not affect the day and time, there is no need for the user to operate the daylight saving time switch to also adjust the day and time. It is therefore sufficient for the user to operate the daylight saving time switch during the same week as the week to be set in the new daylight saving time rule, and user convenience can be improved.

Preferably in an electronic timepiece according to the invention, the controller, when the start time or end time of the daylight saving time rule to be corrected is defined by a specific date and time, changes the date to the date of the timing when the daylight saving time switch was operated, and does not change the time.

This aspect of the invention enables easily changing a daylight saving time rule by identifying the date when the daylight saving time switch is operated, and setting the time the same as before (in the existing rule).

Furthermore, because the timing of daylight saving time switch operation does not affect the time attribute, there is no need for the user to operate the daylight saving time switch to also adjust the time. It is therefore sufficient for the user to operate the daylight saving time switch on the same date as the date to be set in the new daylight saving time rule, and user convenience can be improved.

Preferably in an electronic timepiece according to the invention, when the daylight saving time implementation period to be corrected is not defined, the controller, when the daylight saving time state is changed from off to on by the daylight saving time switch, determines if the timing of daylight saving time switch operation is within a period that is valid as a start time of the daylight saving time implementation period, and if the timing is within a valid period, sets the month and week of the timing of the daylight saving time switch operation, and a previously set day and time, as the start time of the daylight saving time implementation period. When the daylight saving time state is changed from on to off by the daylight saving time switch, the controller determines if the timing of daylight saving time switch operation is within a period that is valid as the end time of the daylight saving time implementation period, and if the timing is within a valid period, sets the month and week of the timing of the daylight saving time switch operation, and a previously set day and time, as the end time of the daylight saving time implementation period.

When configuring a new daylight saving time rule for a time zone in which daylight saving time is not implemented, this aspect of the invention determines if the current time is in a period that is valid as a time to start or a time to end daylight saving time, and, only if the current time is valid, creates a daylight saving time rule based on the month and week when the operator was pushed, and a predetermined default day and hour. This prevents creating a daylight saving time rule when the operator is operated at the wrong time. Therefore, because the controller executes a rule setting process when the probability is high that the user operated the operator to set a daylight saving time rule, a correct daylight saving time rule can be defined.

An electronic timepiece according to another aspect of the invention preferably also has a positioning information satellite receiver configured to receive satellite signals transmitted from positioning information satellites, and acquire current location and time information; and the location information setting device sets the location information based on the current location acquired by the positioning information satellite receiver.

In this aspect of the invention, the positioning information satellite receiver receives satellite signals transmitted from GPS or other positioning information satellites, and acquires current location and time information. The location information setting device then sets the location information acquired in the reception process, and the time display displays time based on the time zone and daylight saving time rule corresponding to the location information.

As a result, if the user of the electronic timepiece executes the satellite signals reception process in the location to which the user has travelled, the electronic timepiece can automatically determine the time zone and whether or not daylight saving time is in effect, automatically set the correct local time, and thereby improve convenience.

In an electronic timepiece according to another aspect of the invention, the location information setting device includes a geographical information display on which is displayed geographical information identifying location information, a hand capable of indicating the geographical information, and a hand operator capable of moving the hand; and the location information setting device sets the location information based on the geographical information indicated by the hand moved by the hand operator.

In this aspect of the invention, the user sets the location information by moving the hand by the hand operator, such as the crown or button, to indicate geographical information, such as the name of a city, displayed on the electronic timepiece. As a result, the user can manually set the location information even on an electronic timepiece that does not have a positioning information satellite receiver, or on an electronic timepiece that has a positioning information satellite receiver but the receiver cannot receive satellite signals because the user is on an airplane or other environment where satellite signals cannot be received. The controller of the electronic timepiece then automatically determines the time zone and whether or not daylight saving time is in effect based on the location information that was set, and automatically sets the correct time. The user can therefore set the local time at the destination while still on board an airplane, and user convenience can be improved.

Preferably in an electronic timepiece according to another aspect of the invention, the controller is configured to execute an automatic daylight saving time mode automatically applying daylight saving time according to the daylight saving time rule, and a manual daylight saving time mode applying or not applying daylight saving time according to operation of the daylight saving time switch; and sets the automatic daylight saving time mode when a daylight saving time rule is corrected by operation of the daylight saving time switch.

When a daylight saving time is corrected by operating the daylight saving time switch, this configuration is automatically set to the automatic daylight saving time mode, and the electronic timepiece, based on the corrected rule, can automatically turn the daylight saving time mode on and off. As a result, after correcting a daylight saving time rule, the user does not need to reset the automatic daylight saving time mode, and user convenience can be improved.

An electronic timepiece according to another aspect of the invention preferably also has a warning display configured to display, when in the automatic daylight saving time mode, the approach of a change in daylight saving time a specific time before the start and end of daylight saving time. The controller is configured to execute an automatic daylight saving time mode automatically applying daylight saving time according to the daylight saving time rule, and a manual daylight saving time mode applying or not applying daylight saving time according to operation of the daylight saving time switch; and switches from the automatic daylight saving time mode to the manual daylight saving time mode if the daylight saving time switch is operated while the approach of a change in daylight saving time is displayed by the warning display.

This aspect of the invention changes to the manual daylight saving time mode when the daylight saving time switch is operated while displaying a warning notifying the user that a change in the daylight saving time setting is coming. As a result, automatically turning the daylight saving time mode on or off based on the daylight saving time rule can be prevented. When a daylight saving time rule has been changed, this configuration can prompt the user to change the daylight saving time rule by warning the user that a change in daylight saving time based on the old rule is approaching. Because automatic application of the old daylight saving time rule can be prevented, the daylight saving time setting can be prevented from changing at a timing different from the new rule, and the correct current local time can be displayed.

Preferably, an electronic timepiece according to another aspect of the invention also has a daylight saving time change display configured to display change in the daylight saving time mode for a specific time after daylight saving time starts and after daylight saving time ends.

Because this configuration displays, by the daylight saving time change display, that a change in daylight saving time occurred, the user can easily know that daylight saving time started or daylight saving time ended, and user convenience can be improved.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 illustrates the configuration of a time zone setting table in the first embodiment of the invention.

FIG. 5 illustrates the configuration of daylight saving time rule table in the first embodiment of the invention.

FIG. 6 illustrates the configuration of time zone setting correction table in the first embodiment of the invention.

FIG. 14 illustrates the configuration of a time zone setting table in the second embodiment of the invention.

FIG. 15 illustrates the configuration of daylight saving time rule table in the second embodiment of the invention.

FIG. 16 illustrates the configuration of time zone setting correction table in the second embodiment of the invention.

DESCRIPTION OF EMBODIMENTS

Embodiment 1

An electronic timepiece 1, which is an electronic device, is described below according to a first embodiment of the invention with reference to the accompanying figures.

Figure 1:
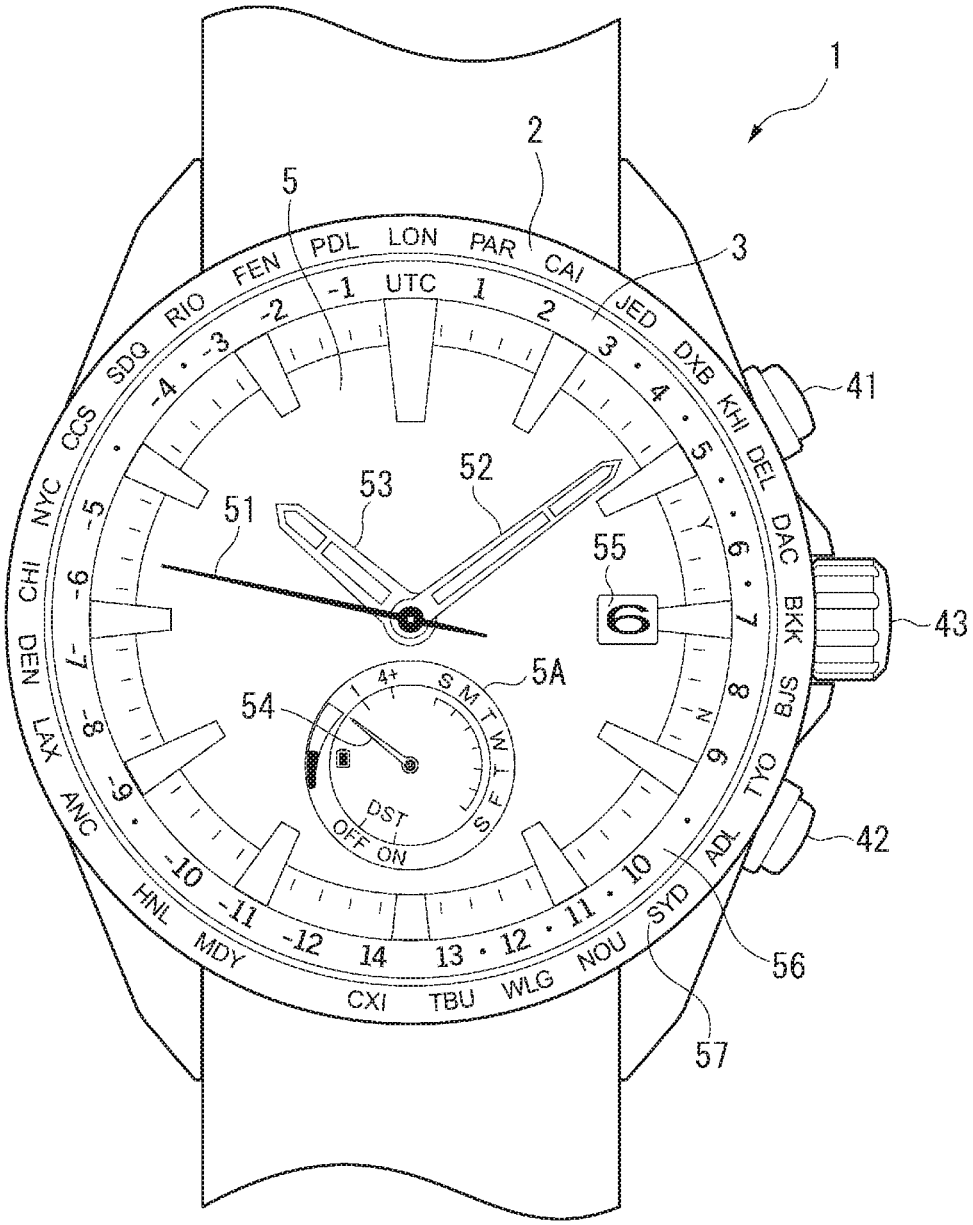
FIG. 1 is a plan view of an electronic timepiece according to a first embodiment of the invention.
Figure 2:
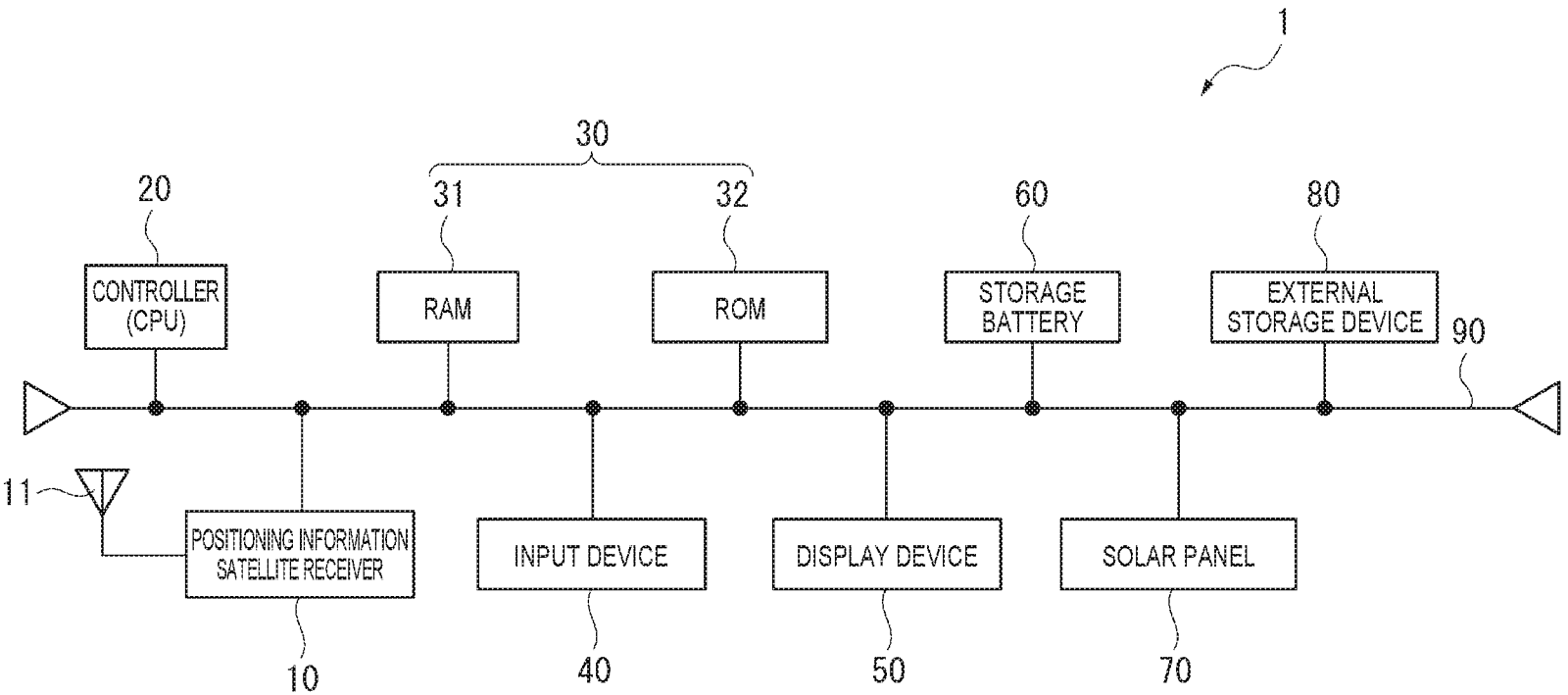
FIG. 2 is a block diagram illustrating the circuit configuration of the electronic timepiece according to the first embodiment of the invention.

FIG. 1 is a plan view of the electronic timepiece 1, and FIG. 2 schematically illustrates the configuration of the main circuits of the electronic timepiece 1.

As shown in FIG. 1, the electronic timepiece 1 has an external case 2.

The external case 2 is cylindrical and made of metal. Of the two openings in the external case 2, the opening on the front (face) side is covered by a watch crystal, and the opening on the back side is covered by a back cover. In the side of the external case 2 are disposed button A 41, button b 42, and a crown 43 as the input device (operating module) 40 described below.

Display Device of the Electronic Timepiece

The display device 50 inside the external case 2 for displaying the time and other information includes a dial ring 3, dial 5, hands 51, 52, 53, 54, calendar wheel (date wheel) 55, and a drive mechanism (not shown in the figure) for driving the hands 51 to 54 and calendar wheel 55.

The dial ring 3 is formed in a ring shape.

The dial 5 is a round disc with time markers inside the external case 2. A subdial 5A is disposed at the 6:00 position offset from the plane center of the dial 5.

Hands 51, 52, 53 are center hands attached to a center pivot disposed in the plane center of the dial 5. The center pivot comprises three individual pivots to which the hands 51, 52, 53 are attached.

On the inside circumference side of the dial ring 3 around the outside circumference of the dial 5 are markers dividing the inside circumference into 60 equal parts. Using these markers, hand 51 indicates the second of the current time; hand 52 indicates the minute of the current time; and hand 53 indicates the hour of the current time. In other words, hand 51 is the second hand, hand 52 is the minute hand, and hand 53 is the hour hand 53, and the hands 51, 52, 53 and dial 5 embody a time display device for indicating the time.

Hand 54 is a mode indicator attached to a pivot disposed in the plane center of the subdial 5A.

Along the outside circumference of the subdial 5A, in the area between approximately 6:00 and 8:00 referenced to the plane center of the subdial 5A, are the letters DST (indicating daylight saving time), ON, and OFF. These markers are used to indicate information related to daylight saving time, when hand 54 points to ON, daylight saving time is in effect, and when hand 54 points to OFF, daylight saving time is not in effect, that is, standard time is displayed.

Along the outside circumference of the subdial 5A, in the area between approximately 1:00 and 4:00 referenced to the plane center of the subdial 5A, are the uppercase English letters S (Sunday), M (Monday), T (Tuesday), W (Wednesday), T (Thursday), F (Friday), S (Saturday) indicating the days of the week. The hand 54 indicates the day of the week by pointing to the appropriate day marker.

Along the outside circumference of the subdial 5A, in the area between approximately 9:00 and 10:00 referenced to the plane center of the subdial 5A, is a sickle shaped marker along the circumference. This marker is a power indicator for the storage battery 60, and the power reserve of the storage battery 60 is indicated by the hand 54 pointing to the position corresponding to the remaining battery capacity.

Along the outside circumference of the subdial 5A, in the area between approximately 11:00 and 12:00 referenced to the plane center of the subdial 5A, are the numeric markers 1 and 4+. These markers indicate the reception mode of the positioning information satellite receiver 10. The hand 54 points to the 1 marker when in the timekeeping mode for acquiring timekeeping information, and the hand 54 points to the 4+ marker when in the positioning mode for acquiring time information and positioning information.

This hand 54 is therefore a mode indicator for indicating information. The mode indicator 54 normally indicates the day of the week, but indicates the reception mode during the satellite signal reception operation.

The mode indicator 54 indicates whether daylight saving time is ON (implemented) or OFF (not implemented) when the time changes between daylight saving time and standard time (when daylight saving time starts and when daylight saving time ends), and when the daylight saving time rules are being changed by manual operation.

When an operation to display the power reserve is performed, or the power reserve drops below a specific threshold, the mode indicator 54 operates as a power reserve indicator.

Markers 56 indicating the time difference to UTC (Coordinated Universal Time) are disposed on a scale around the inside circumference of the dial ring 3. Mostly numbers indicating the time difference to UTC are used as the markers 56, but other markers (non-numeric black dots in this example) are also used.

City name information 57, representing the name of a city using the standard time corresponding to a marker 56 indicating the time difference to UTC shown on the dial ring 3, is displayed on the external case 2 around the dial ring 3 beside the time difference markers 56.

By pointing to a marker 56 or city name information 57, the second hand 51 displays the currently set time difference or the time difference being selected.

Circuit Design of the Electronic Timepiece

The circuit design of the electronic timepiece is described next.

As shown in FIG. 2, the electronic timepiece 1 has a positioning information satellite receiver (GPS module) 10, controller (CPU) 20, memory device 30, input device 40, display device 50, storage battery 60, solar panel 70, and external storage device (memory) 80. The memory device 30 includes RAM 31 and ROM 32. These devices exchange data through a data bus 90.

The input device 40 includes disposed button A 41, button B 42, crown 43, and an input detector that detects operation of button A 41, button B 42, and the crown 43. As described below, button B 42 functions as a DST switch for changing the daylight saving time setting to implemented (ON) or not implemented (OFF).

The display device 50 comprises the four hands 51 to 54 and the motor and wheel train that drive the hands 51 to 54.

The storage battery 60 is a rechargeable battery that stores power generated by the solar panel 70, which is a power generator, and the storage battery 60 and solar panel 70 embody a power supply that supplies power to the electronic timepiece 1.

Configuration of the Positioning Information Satellite Receiver

The positioning information satellite receiver 10 (GPS device) has a GPS antenna 11, processes satellite signals received through the GPS antenna 11, and acquires time information and positioning information.

The GPS antenna 11 in this example is a patch antenna that receives satellite signals from multiple GPS satellites. The GPS antenna 11 is disposed on the back cover side of the dial 5, and is configured to receive radio frequency signals through the crystal and dial 5 of the electronic timepiece 1.

The dial 5 and crystal are therefore made from a material through which RF signals, which in this example are satellite signals transmitted from GPS satellites, can pass. In this example, the dial 5 is made of plastic.

The positioning information satellite receiver 10 includes an RF (radio frequency) unit that receives and converts satellite signals transmitted from the GPS satellites to digital signals, a baseband unit that executes a correlation process and synchronizes with the received signals, and an information acquisition unit that acquires time information and positioning information from the navigation message (satellite signals) demodulated by the baseband unit.

The RF unit includes a bandpass filter, PLL circuit, intermediate frequency (IF) filter, VCO (Voltage Controlled Oscillator), ADC (analog/digital converter), mixer, LNA (Low Noise Amplifier), and intermediate frequency (IF) amplifier.

The satellite signals extracted by the bandpass filter are amplified by the LNA, mixed by the mixer with the VCO signal, and down converted to an IF (Intermediate Frequency) signal. The IF signal that was mixed by the mixer passes through the IF amplifier and IF filter, and is converted to a digital signal by the ADC.

The baseband unit has a local code generator that generates a local code from a C/A code that is the same as the C/A code used by the GPS satellite for transmission, and a correlator that calculates the correlation between the local code and the satellite signal output from the RF unit.

If the correlation calculated by the correlator equals or exceeds a specific threshold, the local code is determined to match the C/A code used in the received satellite signals, and the satellite signal can be locked onto (synchronized). By thus correlating the received satellite signals with the local code, the navigation message can be demodulated.

The information acquisition unit acquires time information and positioning information from the navigation message demodulated by the baseband unit. More specifically, the navigation messages transmitted from the GPS satellites carry a preamble, TOW (Time of Week, also known as the Z count) in a HOW (Handover Word), and subframe data. The subframe data goes from subframe 1 to subframe 5, and each subframe includes satellite correction data such as the week number and satellite health status data, ephemeris (detailed orbit information about the transmitting GPS satellite), and an almanac (coarse orbit information about all GPS satellites).

The information acquisition unit extracts specific data portions from the received navigation message, and acquires the time information and positioning information. The receiver in this embodiment of the invention is thus embodied by the positioning information satellite receiver 10.

Memory

Programs executed by the controller 20 are stored in the ROM 32 of the memory device 30. Time information and positioning information acquired by receiving satellite signals, for example, are stored in the RAM 31 of the memory device 30.

External Storage Device

Figure 3:
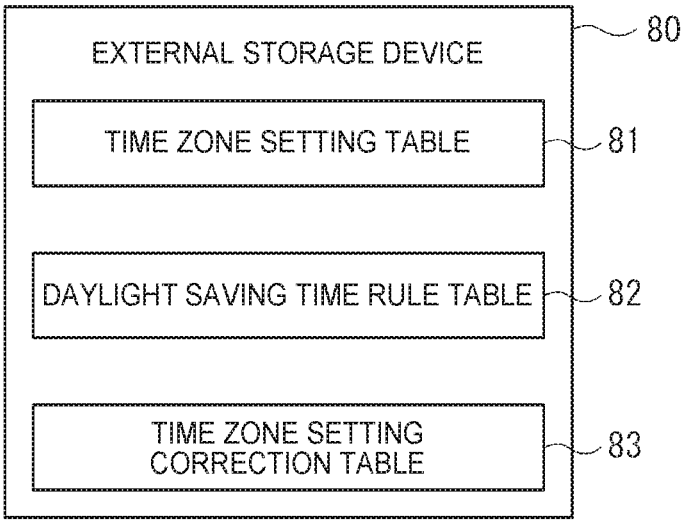
FIG. 3 is a block diagram illustrating the configuration of an external memory device in the first embodiment of the invention.

The external storage device 80, which is a memory device, is a storage device that stores data rewritably, and as shown in FIG. 3 stores a time zone setting table 81, a daylight saving time rule table 82, and a time zone setting correction table 83.

Controller Configuration

The controller 20 (CPU) controls operations according to programs stored in ROM 32. For example, when the controller 20 detects a reception operation was started by the user operating the button A 41 or other part of the input device 40, the controller 20 functions as a reception controller to drive the positioning information satellite receiver 10 and execute the satellite signals reception process if a scheduled reception time is set and the current time equals the reception time.

The controller 20 also functions as a timekeeping means that updates the internal time using a reference signal from a reference signal generator (oscillator) such as a crystal oscillator not shown, and keeps the current time.

Based on positioning information (latitude and longitude) acquired by the positioning information satellite receiver 10 described above, the controller 20 references the time zone setting table 81 stored in the external storage device 80 to acquire time difference data for the current location, and thus functions as a positioning information setter. The controller 20 also functions as a current location time calculator that calculates the current time at the current location based on the time information (GPS time plus leap second value) acquired by the positioning information satellite receiver 10 and the acquired time difference data.

The controller 20 also updates the internal time kept using the reference signal to the calculated current time. When a satellite signal is received, the internal time is therefore automatically corrected to the correct time based on the received data.

As described below, the controller 20 is configured to operate in an automatic daylight saving time mode (automatic DST mode) and a manual daylight saving time mode (manual DST mode).

The automatic DST mode is a mode for automatically implementing daylight saving time, that is, automatically changing whether or not to turn the daylight saving time mode on or off, according to the daylight saving time rules. As a result, the controller 20 automatically updates the current time to daylight saving time based on the time zone setting table 81 and daylight saving time rule table 82. The controller 20 then displays the updated current time with the hands 51, 52, 53.

The manual DST mode is a mode for implementing daylight saving time, that is, turning daylight saving time on or off, in response to a specific DST switching operation, that is, pushing the button B 42, which is a DST switch.

As described below, the controller 20 updates the daylight saving time rule table 82 and time zone setting correction table 83, and corrects the daylight saving time rules, according to the timing when the button B 42, which is the DST switch, is operated to change the daylight saving time setting.

Data Structure of the Time Zone Setting Table

The data structure of the time zone setting table 81 is described next with reference to FIG. 4.

A time zone is expressed by the time difference between the standard time in a particular country or region and UTC (Coordinated Universal Time). A time zone is therefore theoretically set according to the longitude. However, the boundary lines of the actual time zones (time difference regions) often conform to national borders. Furthermore, daylight saving time (summer time) is normally set country by country, and in some countries, whether or not daylight saving time is implemented is determined region by region.

Therefore, as shown in FIG. 4, region information identifying a specific region, the time zone (time difference), and a DST number identifying a set of daylight saving time rules, are relationally stored in the time zone setting table 81. Each region is a rectangular area defined by two longitude lines and two latitude lines. As a result, the region information identifying a region comprises the coordinates (latitude and longitude) of the northwest corner of the region, and the coordinates (latitude and longitude) of the southeast corner of the region.

In the time zone column is stored the time difference to UTC.

The DST number (daylight saving time number) stores the number identifying the daylight saving time rules in the country or region identified by the region information. The DST numbers correspond to the DST numbers in the daylight saving time rule table 82 shown in FIG. 5.

Data Structure of the Daylight Saving Time Rule Table

The data structure of the daylight saving time rule table 82 is described next with reference to FIG. 5.

DST numbers, DST start and DST end data, and DST time difference values are stored in the daylight saving time rule table 82.

The DST number 0 in the daylight saving time rule table 82 is used for regions in which daylight saving time is not implemented. As a result, the DST start and DST end are set to None, and the DST time difference is +0 hours.

The DST number for regions in which daylight saving time is not implemented (such as Japan) is therefore set to 0 in the time zone setting table 81.

The starting time of the daylight saving time implementation period is stored as the DST start value. The ending time of the daylight saving time implementation period is stored as the DST end value. These values are stored based on the start time and end time patterns in each country (region) where daylight saving time is implemented.

For example, daylight saving time in the United States is currently implemented from 02:00 on the second Sunday in March to 02:00 on the first Sunday in November. The DST number for regions in the United States is therefore set to 2.

There are also places where daylight saving time is implemented on fixed dates. For these locations, the date and time daylight saving time starts (such as March 27, 22:00), and the date and time daylight saving time ends (such as September 27, 23:00), can therefore be stored as the DST start and DST end values.

The time change required to implement daylight saving time (typically +1 hour) is stored as the DST time difference in the daylight saving time rule table 82.

Data Structure of the Time Zone Setting Correction Table

As shown in FIG. 6, the time zone setting correction table 83 has the same data structure as the time zone setting table 81, and when the daylight saving time rule for a specific region is changed, stores the region information (latitude and longitude) for that region, the time zone (time difference), and the corrected DST number.

The reason a time zone setting correction table 83 is provided in addition to the time zone setting table 81 in this embodiment is described next.

A time zone and DST number are stored in the time zone setting table 81 for each rectangular area defined by two coordinates, the northwest and southeast coordinates. To increase time zone precision, the rectangular areas can be simply made smaller. However, if the rectangular areas are made smaller, the amount of data increases. For example, if a single rectangular area is sized to approximately 0.25 degrees latitude and longitude, approximately one million data sets are required to cover every time zone in the world.

Because the capacity of RAM 31 in the electronic timepiece 1 is not large, the time zone setting table 81 cannot be stored in RAM 31. As a result, an external storage device 80 is disposed to the electronic timepiece 1, but because the capacity of an external storage device 80 built in to a wristwatch is limited, the time zone setting table 81 is compressed for storage. This means the content of the time zone setting table 81 cannot be directly corrected (changed), and a separate time zone setting correction table 83 is therefore provided.

Reception Process

The process whereby satellite signals are received and the time is corrected in an electronic timepiece 1 according to this embodiment of the invention is described next.

Positioning Process

The electronic timepiece 1 requires knowing the time difference to UTC, which is acquired by receiving satellite signals, in order to correct the current time at the current location.

The positioning process is therefore executed when current location information is not stored in RAM 31, such as after the electronic timepiece 1 is initialized.

The positioning process is also executed when the user performs a manual operation to start the positioning reception operation. This typically happens when the user travels to a location in a difference time zone, such as when travelling to another country, and the time must be adjusted to the current local time.

The positioning information satellite receiver 10 of the electronic timepiece 1 starts reception when the button A 41 is pushed, and acquires time information and positioning information from the positioning information satellites.

The controller 20 searches the time zone setting table 81 for region information containing the location identified by the acquired positioning information (the latitude and longitude of the current location), and copies the time zone and DST number related to that region information from the time zone setting table 81 to RAM 31.

The controller 20 then searches the time zone setting correction table 83 for region information containing the acquired positioning information, and if such region information is found, acquires from the time zone setting correction table 83 and stores in the RAM 31 the time zone and corrected DST number corresponding to that region information.

The time zone setting table 81 contains default data stored when the electronic timepiece 1 was shipped from the factory.

If the time zone setting information is changed by a manual correction operation such as described below, the corrected content is added to the time zone setting correction table 83 without directly changing the time zone setting table 81.

The controller 20 therefore searches the time zone setting correction table 83 in addition to the time zone setting table 81 to acquire the DST number and corrected DST number.

If the corrected DST number or DST number stored in RAM 31 is a value other than 0, the controller 20 acquires from the daylight saving time rule table 82 and stores in RAM 31 the daylight saving time rules (daylight saving time start (DST start) and daylight saving time end (DST end)) corresponding to the DST number.

The controller 20 then applies the time zone (time difference) stored in RAM 31 to the time information (UTC) acquired from the positioning information satellites, thereby acquiring the time at the current location (current local time).

Next, if the current local time that was acquired is during the daylight saving time implementation period identified by the daylight saving time rules stored in RAM 31, the controller 20 adds the DST time difference to the current local time to acquire the corrected current local time. If the corrected DST time difference was acquired, the daylight saving time rule corresponding to the corrected DST number is applied.

After controlling the display device 50 to display the corrected current local time by the hands 51, 52, 53, the controller 20 continues displaying the current time. When the daylight saving time implementation period (start time) is reached, the mode indicator 54 indicates for a specific time (such as one day) that daylight saving time is in effect, and when the daylight saving time end time is reached, the mode indicator 54 indicates for a specific time (such as one day) that daylight saving time is no longer in effect. The subdial 5A and mode indicator 54 thus embody a daylight saving time indicator that indicates a change in the daylight saving time setting for a specific time after daylight saving time starts and a specific time after daylight saving time ends.

Note that executing the positioning process may not be required if the time zone is selected and the time difference information was previously stored in RAM 31 by operating the crown 43 or other input device.

In this case, the positioning information satellite receiver 10 acquires time information by locking onto at least one positioning information satellite and receiving satellite signals therefrom, and applies the time zone stored in RAM 31 to determine the current local time.

If satellite signals cannot be received, the controller 20 acquires the current local time by applying the time zone information to the internal time that was previously acquired and kept by the reference clock output by a crystal oscillator, for example.

Turning Daylight Saving Time On and Off

Next, the process of turning daylight saving time on and off in response to the user pushing button B 42, which is the DST switch, is described below based on the flow chart in FIG. 7.

If the button B 42, which is the DST switch, is pushed during the normal display of the current time, the controller 20 goes to the manual DST mode (step S1).

Note that the operation of switching DST On or DST Off by pushing the button B 42 is not limited to during the normal display of the current time, and may be effected by operating the crown 43 or button A 41 to go to a daylight saving time switching mode, and then pushing button B 42.

When button B 42 is pushed, the controller 20 determines whether or not the daylight saving time mode is on (step S2). More specifically, because button B 42, the DST switch, switches between DST On (daylight saving time is in effect) and DST Off (daylight saving time is not in effect), the controller 20 must first determine whether the current setting is DST On or DST Off.

Operation when Changing to DST On

If the controller 20 determines NO in step S2, the controller 20 turns the DST mode On (daylight saving time is in effect) (step S3).

Next, the controller 20 determines if the difference between the timing (current time) when button B 42 was pushed, and the DST start time, is within a specific period (step S4). This specific period is a period during which the likelihood is high that the time when button B 42 was operated was at a change in the daylight saving time implementation period, and may be set referenced to actual past changes in the daylight saving time implementation period in each country or region. Based on past changes in daylight saving time implementation periods commonly being within one month, the specific period in this example is set to one month.

Therefore, when daylight saving time is off and button B 42 is pushed, if the difference between the timing (current time) when button B 42 was pushed and the DST start value is within the specific period (the change in the start of the DST implementation period is within the specific period) (step S4: YES), the controller 20 corrects the DST start data of the daylight saving time implementation period based on a specific condition (step S5).

If the corrected DST number is stored in the RAM 31 at this time, the controller 20 first compares the DST start time corresponding to the corrected DST number and the current time. If the result is that the specific period was exceeded, the controller 20 compares the DST start time of the original DST number and the current time. More specifically, if the difference between the current time and the DST start time corresponding to either the corrected DST number or the original DST number is within the specific period (one month in this example), the controller 20 adjusts (changes) the DST start data.

For example, the daylight saving time implementation period is generally defined by the month, week, day, and time, such as from 02:00 on the second Sunday in March to 02:00 on the first Sunday in November. Past changes in the daylight saving time implementation period are also changed in week units, such as from 02:00 on the first Sunday in April to 002:00 on the second Sunday in March. Therefore, when the DST start data of the daylight saving time rule to be corrected in step S5 is defined by the month, week, day, and time, the controller 20 does not change the day and time, and only changes the month and week based on the timing (current time) when the button B 42, the DST switch, was pushed.

For example, if the current time when button B 42 was pushed to change to DST On is within one month from the DST start, the controller 20 changes the month and week of the current DST start data to the month and week of the time when button B 42 was pushed, and does not change the day and time.

In other words, if the week is assumed to begin on Sunday, to change the DST start information from 02:00 on the first Sunday in April to 02:00 on the second Sunday in March, the button B 42 can be simply pushed to change to the DST On state during the second week in March (the week starting from the second Sunday).

Because daylight saving time is implemented during the night to minimize the impact on daily life when daylight saving time start and ends, the user may change the timepiece to DST start the day before DST starts. As a result, whether the change in the implementation period applies to the current week or the next week can be determined based on the day of the week. For example, if daylight saving time is set to start on Sunday, and button B 42 is pushed sometime from Saturday in the first week of March and Friday in the second week of March, the DST start setting can be changed to the second Sunday in March.

In some locations, the daylight saving time implementation period to be corrected is defined not in week units, but by a specific date, such as 00:00 on March 20. In this case, the DST start and DST end of the daylight saving time implementation period is corrected based on the date when the button B 42 is pushed to change to DST Off or DST On.

When the DST start data is corrected in step S5, the controller 20 determines the start of the daylight saving time implementation period was correctly adjusted by the user, and changes from the manual DST mode to the automatic DST mode (step S6).

The controller 20 then adjusts the current local time, that is, the internal time that is kept based on the reference signal (step S7). For example, if step S4 returned YES, the DST start data was changed in step S5, and the automatic DST mode was set in step S6, in step S7 daylight saving time is on, and the current local time in daylight saving time is set by adding the DST time difference (+1) to the internal time.

The controller 20 then displays the corrected current local time with the hands 51, 52, 53, and indicates by the mode indicator 54 that daylight saving time is in effect (DST On) (step S8).

However, if step S4 returns NO, the controller 20 determines the operation was not to correct the DST start time, but instead to turn the daylight saving time mode on (change to the DST On state), and corrects the current local time in step S7 (adds +1 hours, the DST time difference), and goes to step S8.

Operation When Changing to DST Off

Control when button B 42 is pushed in the DST On state is described next.

If button B 42 is pushed in the DST On state, the controller 20 determines YES in step S2, the controller 20 turns the DST mode Off (turns the daylight saving time mode off (DST is not in effect)) (step S11).

Next, the controller 20 determines if the difference between the timing (current time) when button B 42 was pushed, and the DST end time, is within a specific period (step S12). This specific period is usually the same as the period used for the decision in step S4, and in this example is set to one month. However, the specific periods used in step S4 and step S12 may be different. For example, the specific period in step S4 may be four weeks, and the specific period used in step S12 may be five weeks.

If button B 42 is pushed in the DST On state, and the difference between the timing (current time) when button B 42 was pushed, and the DST end time, is within the specific period (the change in the end of the DST implementation period is within the specific period) (step S12: YES), the controller 20 corrects the DST end data of the daylight saving time implementation period based on a specific condition (step S13).

As in step S5, if the corrected DST number is stored in the RAM 31 at this time, the controller 20 first compares the DST end time corresponding to the corrected DST number and the current time. If the result is that the specific period was exceeded, the controller 20 compares the DST end time of the original DST number and the current time. More specifically, if the difference between the current time and the DST end time corresponding to either the corrected DST number or the original DST number is within the specific period (one month in this example), the controller 20 adjusts (changes) the DST end data.

As when the DST mode is changed to DST On, the controller 20 then changes from the manual DST mode to the automatic DST mode (step S6), and adjusts the current local time (step S7). In this event, however, because the DST mode was changed from DST On to DST Off, in step S7 the controller 20 sets the current local time by subtracting the DST time difference (+1) from the internal time. As a result, the current local time is normally moved back one hour.

The controller 20 then displays the corrected current local time and the DST Off state by setting the hands 51, 52, 53 and mode indicator 54 appropriately (step S8).

However, if step S12 returns NO, the controller 20 determines the operation was not to correct the DST end time, but instead to turn the daylight saving time mode off (change to the DST Off state), and corrects the current local time in step S7 (changes the time from DST On to DST Off), and goes to the display operation of step S8.

Updating the Daylight Saving Time Rule Table and Time Zone Setting Correction Table When correcting the DST start and DST end times of the daylight saving time implementation period ends, the controller 20 adds the corrected DST start and DST end data, and adds a new DST number, to the daylight saving time rule table 82 shown in FIG. 5. FIG. 5 shows an example of a new daylight saving time rule identified by the added DST number 15.

Because this DST number is stored as a corrected DST number in the time zone setting correction table 83, the controller 20 acquires the new (added) DST number as a corrected DST number.

The DST time difference data remains the same as the DST time difference data corresponding to the original DST number for which the DST start or DST end value was corrected.

However, if there is a daylight saving time rule containing the same values as the corrected DST start and DST end rules, the controller 20 does not add a new daylight saving time rule, and acquires the DST number of that existing daylight saving time rule as the corrected DST number.

The controller 20 then adds location information (region information), time zone data, and the corrected DST number, to the time zone setting correction table 83 shown in FIG. 6. If the same region information already exists in the time zone setting correction table 83, that is, if the daylight saving time rules for the same region were previously corrected and are corrected again, only the corrected DST number of that region is changed.

If the DST number for a region in the time zone setting table 81 corresponding to the current location, and the corrected DST number for the same region in the time zone setting correction table 83, are the same, the daylight saving time rules for that current location were reset to the default (initial) settings, and the data for the same region in the time zone setting correction table 83 is deleted.

Specific examples of correcting daylight saving time rules are described below with reference to FIG. 8 to FIG. 11.

Example 1: Setting the DST Start to an Earlier Time

Figure 8:
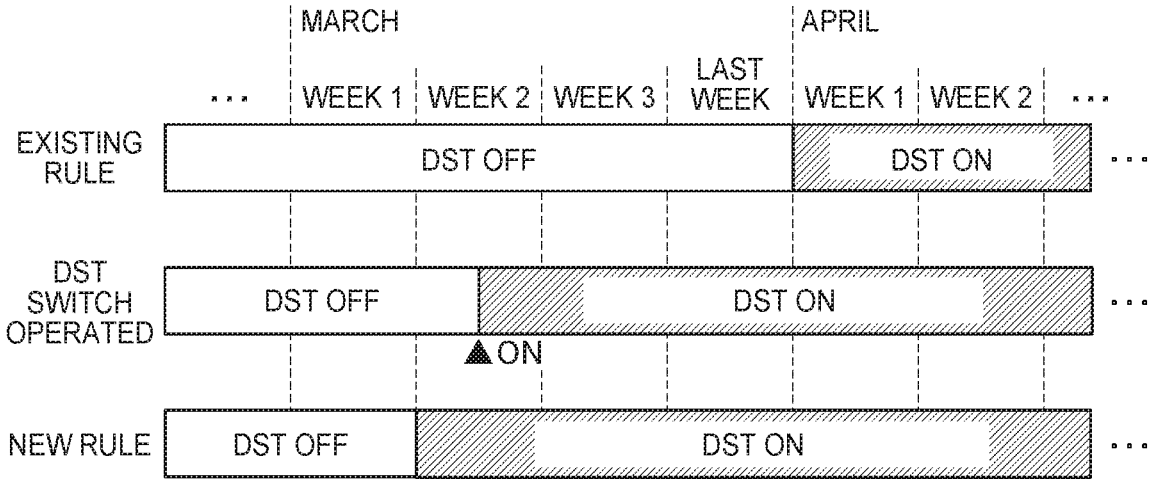
FIG. 8 illustrates a first example of correcting the daylight saving time period.

As shown in FIG. 8, this example supposes that the daylight saving time rule changed and DST start changed from 02:00 on the first Sunday in April to 02:00 on the second Sunday in March. If the user then pushes button B 42 during the second week in March in some location, the controller 20 changes DST from off to on. In this case, because the timing (current time) when DST turned on is within the specific period (one month) from the first Sunday in April, which is the current DST start time, the controller 20 changes the DST start time of the applicable daylight saving time rules to 02:00 on the second Sunday in March.

Example 2: Setting the DST Start to a Later Time

Figure 9:
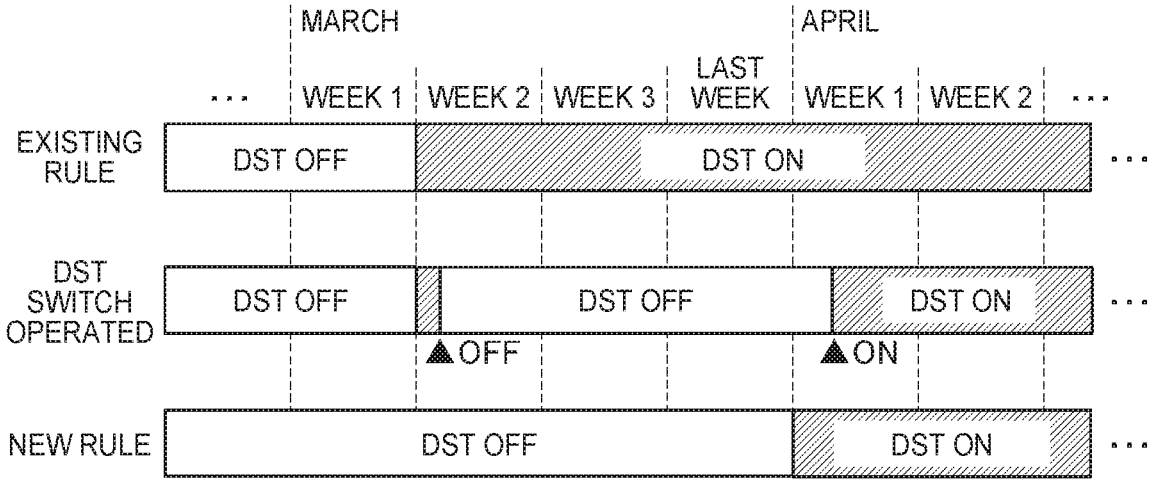
FIG. 9 illustrates a second example of correcting the daylight saving time period.

As shown in FIG. 9, this example supposes the DST start was changed from 02:00 on the second Sunday in March to 02:00 on the first Sunday in April. Because the automatic DST mode is normally enabled before the daylight saving time rule is changed, the controller 20 automatically changes to the DST On mode at 02:00 on the second Sunday in March.

If the user then pushes button B 42 during the second week in March (when DST is on), the controller 20 switches from DST On to DST Off. Because the difference between the DST end and the timing (current time) when button B 42 was pushed to turn DST Off exceeds the specific period (one month), the controller 20 does not change the DST end data of the daylight saving time rule. If the user then pushes button B 42 somewhere during the first week in April when DST is off to switch from DST Off to DST On, the button B 42 was pushed during the specific period (one month) from the second Sunday in March, which is the current DST start time, and the controller 20 therefore changes the DST start of the daylight saving time rules to 02:00 on the first Sunday in April.

Example 3: Setting the DST End to an Earlier Time

Figure 10:
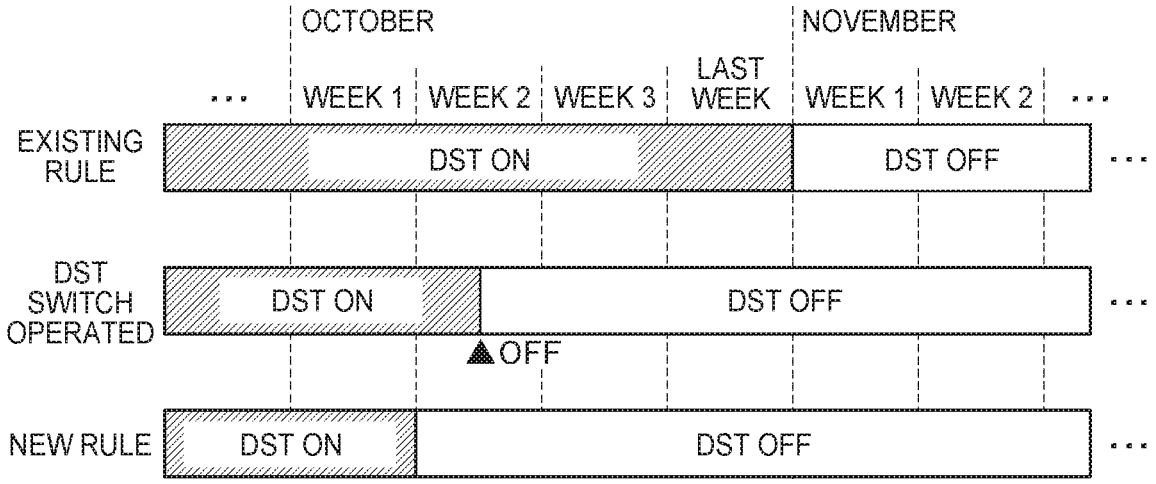
FIG. 10 illustrates a third example of correcting the daylight saving time period.

As shown in FIG. 10, this example supposes that the DST end was changed from 02:00 on the first Sunday in November to 02:00 on the second Sunday in October. If button B 42 is then pushed during the second week in October in some location, the controller 20 changes DST from on to off. In this case, because the timing (current time) when DST turned off is within the specific period (one month) from the first Sunday in November, which is the current DST off time, the controller 20 changes the DST end time of the applicable daylight saving time rules to 02:00 on the second Sunday in October.

Example 4: Setting the DST End to a Later Time

Figure 11:
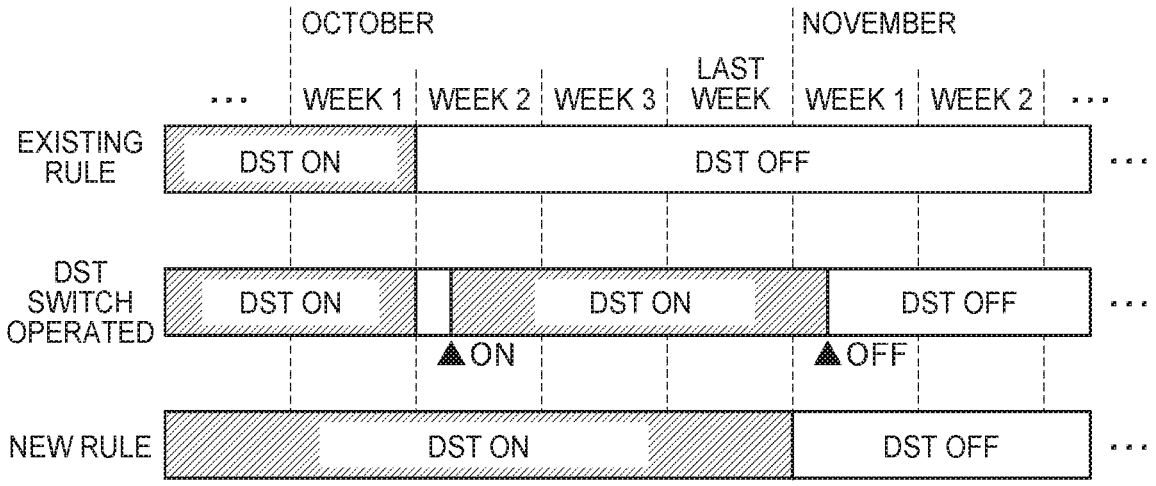
FIG. 11 illustrates a fourth example of correcting the daylight saving time period.

As shown in FIG. 11, this example supposes that the DST end was changed from 02:00 on the second Sunday in October to 02:00 on the first Sunday in November. Because the automatic DST mode is normally enabled before the daylight saving time rule is changed, the controller 20 automatically changes to the DST Off mode at 02:00 on the second Sunday in October.

If the user then pushes button B 42 during the second week in October (when DST is off), the controller 20 switches from DST Off to DST On. Because the difference between the DST start and the timing (current time) when button B 42 was pushed to turn DST On exceeds the specific period (one month), the controller 20 does not change the DST start data of the daylight saving time rule. If the user then pushes button B 42 somewhere during the first week in November when DST is on to switch from DST On to DST Off, the button B 42 was pushed during the specific period (one month) from the second Sunday in October, which is the current DST end time, and the controller 20 therefore changes the DST end data of the daylight saving time rules to 02:00 on the first Sunday in November.

Example 5: Cancelling Implementation of Daylight Saving Time

This example supposes that implementation of daylight saving time was cancelled, and DST was automatically turned on according to the existing daylight saving time. If the user then pushes button B 42, the controller 20 goes to the manual DST mode in step S2 in FIG. 7, and in step S11 changes to DST Off.

Because the difference between the DST end and the timing (current time) when button B 42 was pushed is greater than or equal to the specific period (step S12: NO), the controller 20 does not change the DST end data of the daylight saving time rule, and does not change to the automatic DST mode.

Thereafter, the manual DST mode and DST Off state are maintained until the user pushes the button B 42 and manually turns DST On. As a result, daylight saving time is not turned on automatically, and daylight saving time is not implemented until the user pushes the button B 42.

Effect of Embodiment 1

Effects of the first embodiment are described below.

The electronic timepiece 1 has a button B 42 as a DST switch for turning daylight saving time on (implemented) or off (not implemented), and based on the timing of button B 42 operation to change the DST mode setting on or off, the controller 20 adjusts the daylight saving time rules. As a result, the user of the electronic timepiece 1, by simply operating the button B 42 in relation to the start and end of daylight saving time, can easily change the daylight saving time rules.

More specifically, the daylight saving time rules can be changed by simply operating the button B 42 to switch between DST On and DST Off, there is no need for the user to manually sequentially change the daylight saving time rule settings (starting month, starting week, starting day, starting time, starting date, ending month, ending week, ending day, ending time) as in the related art, a complicated operation is unnecessary, and user convenience can be improved. As a result, daylight saving time rules can be easily adjusted even in an electronic timepiece 1 having a limited display device 50 and input device 40, such as a wristwatch.

Because this embodiment of the invention enables the user to easily correct for changes in the daylight saving time rules, internally stored daylight saving time settings can be quickly and easily changed even when daylight saving time rules change after the electronic timepiece 1 is purchased, and the correct current local time can be displayed.

Furthermore, changing the internal daylight saving time rules by operating the button B 42 is limited to when the timing of the operation is within a specific period (such as one month) after the start or end time of the existing daylight saving time rules (the daylight saving time rules being corrected). Because the daylight saving time rules are therefore corrected only when the likelihood is high that the user operated the button B 42 to change a daylight saving time rule, the daylight saving time rules can be changed correctly.

Furthermore, even if the user mistakenly operates the button B 42 outside this specific period, the DST On or DST Off state is simply changed manually and the displayed time changed accordingly, and the daylight saving time rule itself is not changed. As a result, the correct time can be easily displayed again by simply pushing the button B 42 again. The user unintentionally changing daylight saving time rules can therefore be prevented.

If the DST start and DST end values of the daylight saving time rules are defined by the month, week, day, and time, the controller 20 identifies the month and week based on the timing when the button B 42 is operated and sets the day and time the same as in the existing rule. As a result, the daylight saving time rules can still be changed easily.

Furthermore, because the timing of button B 42 operation does not affect the day and time, the user can simply operate the button B 42 during the same week as the week in the new daylight saving time rules, and user convenience can be improved.

The electronic timepiece 1 also has a positioning information satellite receiver 10, and the controller 20 can acquire positioning information based on the satellite signals received by the positioning information satellite receiver 10, identify the time zone and daylight saving time rules based on the positioning information, and display the time. As a result, by the user of the electronic timepiece 1 starting the satellite signals reception process while travelling or going abroad, the electronic timepiece 1 can automatically determine the time zone and whether or not daylight saving time is in effect, automatically correct the internal time to the correct local time, and thereby improve user convenience.

When a daylight saving time rule is corrected by operating the button B 42, the controller 20 sets the automatic DST mode. The electronic timepiece 1 can therefore automatically apply daylight saving time based on the updated rule, and correct the displayed time. As a result, there is no need for the user to perform an operation to reset the automatic DST mode after changing the daylight saving time rules, and user convenience can be improved.

When daylight saving time turns on or off, the mode indicator 54 points to the DST On or DST Off marker on the subdial 5A. As a result, the user can easily know if daylight saving time was turned on or daylight saving time ended, and user convenience can be improved.

Furthermore, because the mode indicator 54 also displays other mode information such as the day of the week, power reserve, and reception mode, various useful information can be displayed without increasing the number of hands.

The external storage device 80 stores a time zone setting table 81, daylight saving time rule table 82, and time zone setting correction table 83. When a daylight saving time rule is changed, the information about the changed region is stored in the time zone setting correction table 83 without modifying the time zone setting table 81. The invention can therefore also be applied to configurations in which the time zone setting table 81 stores compressed data and modifying data about a specific region is therefore difficult.

Furthermore, because regional data that was modified by a user operation is collectively stored in the time zone setting correction table 83. The original data can therefore be easily restored if needed by the user simply deleting the modified data.

Embodiment 2

A second embodiment of the invention is described next.

Figure 12:
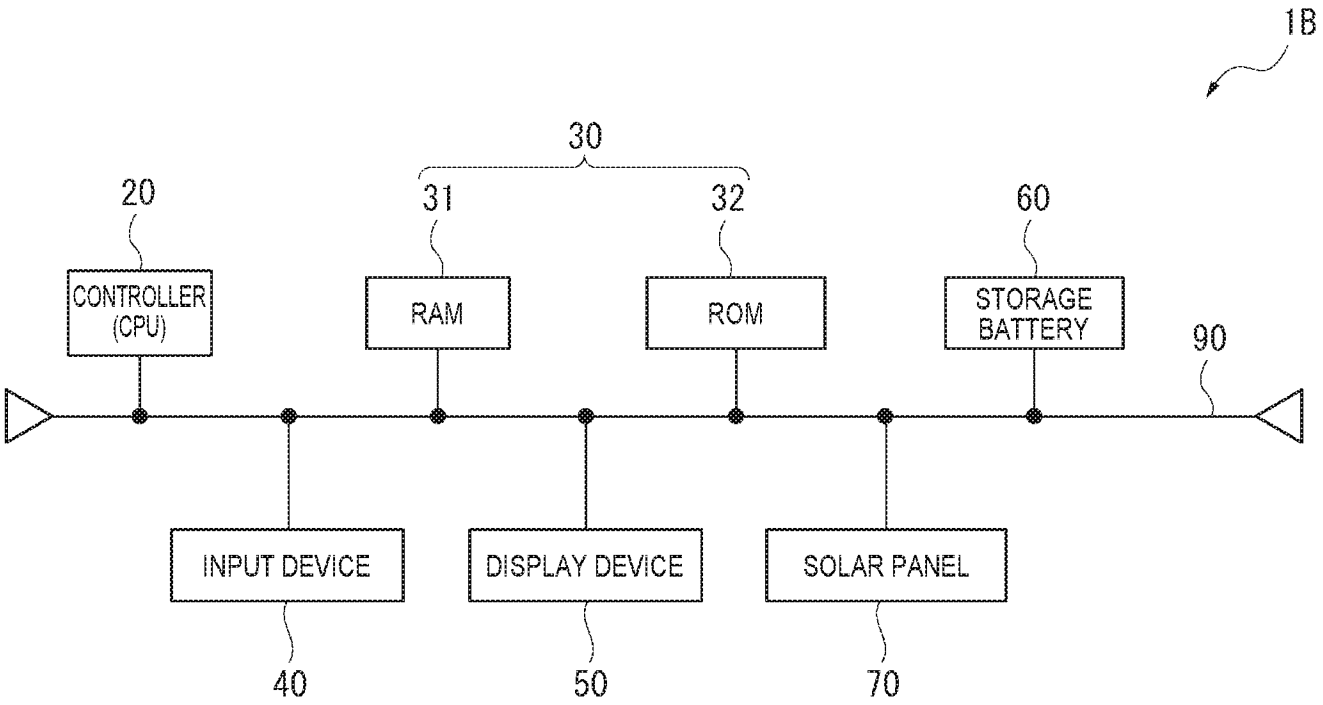
FIG. 12 is a block diagram illustrating the circuit configuration of the electronic timepiece according to a second embodiment of the invention.

As shown in FIG. 12, an electronic timepiece 1B according to the second embodiment of the invention, like the electronic timepiece 1 according to the first embodiment of the invention, has a controller 20, memory device 30 (storage unit), input device 40, display device 50, storage battery 60, and solar panel 70. In other words, the electronic timepiece 1B is configured identically to the electronic timepiece 1 except for not having a positioning information satellite receiver 10 and external storage device 80.

Figure 13:
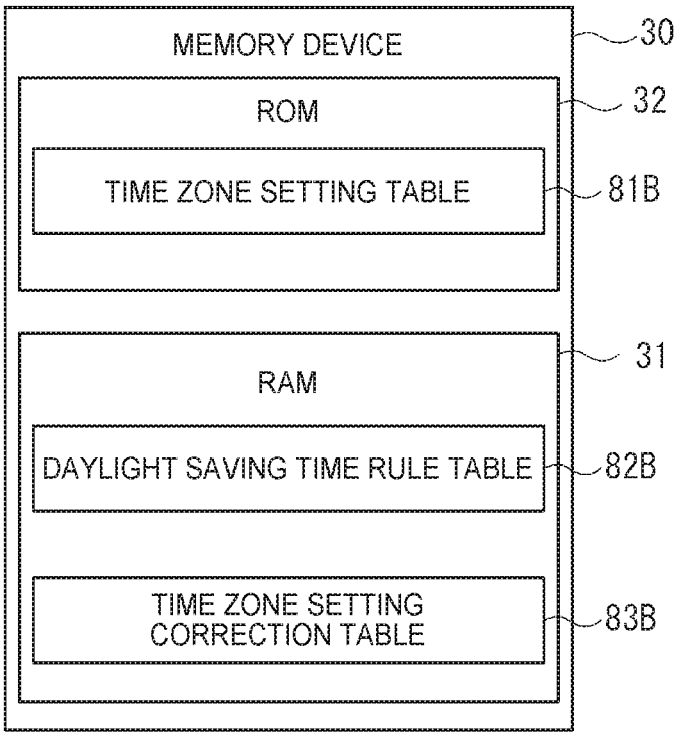
FIG. 13 is a block diagram illustrating the configuration of a memory device in the second embodiment of the invention.

Because the electronic timepiece 1B does not have an external storage device 80, it uses the memory device 30 as storage for the various tables. In other words, as shown in FIG. 13, a time zone setting table 81B is stored in the ROM 32 of the memory device 30. A daylight saving time rule table 82B and time zone setting correction table 83B are stored in RAM 31 of the memory device 30.

As shown in FIG. 14, the time zone setting table 81B relationally stores city numbers, city names, time zones, and DST numbers.

The city number is a serial number corresponding to a city name, and may be set in the order of the time difference from UTC, or in the order of the frequency of city name use.

The city names are the names of major cities commonly associated with a particular time zone, and are used as the geographical information for identifying location information instead of the region information used in the first embodiment.

A time zone is information indicating the time difference to UTC. For example, the time zone +0 for LONDON means that the time difference to UTC is 0 hours; the time zone +9 for TOKYO means that the time difference to UTC is +9 hours; the time zone −5 for NEW YORK means that the time difference to UTC is −5 hours.

There are currently approximately 40 time zones with time differences ranging from −12 hours to +14 hours, and while not shown in the figure, each time zone is stored in the time zone setting table 81B.

The time zone setting table 81B thus comprises approximately 40 data sets, and therefore stores significantly less data than the time zone setting table 81 of the first embodiment, which requires approximately one million data sets. As a result, the time zone setting table 81B can be stored in ROM 32.

The DST number indicates information for applying daylight saving time rules to each time zone. Note that while multiple countries may use the same time zone (time difference), the daylight saving time rules may vary by country. In this case, as described below, the time displayed by the display device 50 can be adjusted to the current local time by the user manually changing the daylight saving time setting (on or off) by operating the button B 42.

As shown in FIG. 15, the daylight saving time rule table 82B is the same as the daylight saving time rule table 82 in the first embodiment, and further description thereof is omitted.

As shown in FIG. 16, the time zone setting correction table 83B is the same as the time zone setting correction table 83 in the first embodiment, and when a daylight saving time rule is changed, stores the changed content.

The time zone setting correction table 83B therefore stores the city number corresponding to the city name, which is the geographical information identifying the location information, the time zone corresponding to the city number (the time difference to UTC), and the corrected DST number. Note that because the city number corresponds to the city name, the city name may be used instead of the city number in the time zone setting correction table 83B.

When a specific operation of the input device 40 is executed to enter the time zone setting mode of the electronic timepiece 1B, the city name can be selected by operating the crown 43 and button A 41 or button B 42 to move the second hand 51. For example, after pulling the crown 43 out to the second stop and entering the time zone setting mode, the crown 43 may be turned, or the button A 41 or button B 42 may be pushed, to move the second hand 51 sequentially to the position indicating the desired time zone, and the crown 43 may then be pushed in from the second stop to the first stop or zero stop while the second hand 51 is pointing to the selected city name, to confirm the selection of the city name.

As in the first embodiment, to correct the DST number of the selected city name, the daylight saving time rules can be changed according to the timing when the button B 42 is pushed to turn the daylight saving time setting of the selected time zone on or off. In this event, as in the first embodiment, the controller 20 stores the corrected DST start, DST end, and DST number in the daylight saving time rule table 82B, and stores the city number corresponding to the selected city name, the time zone, and the corrected DST number, in the time zone setting correction table 83B.

In the second embodiment of the invention, a geographical information display displaying geographical information indicating location information is embodied by the markers 56 on the dial ring 3 and the city name information 57 on the external case 2.

An indicator capable of indicating geographical information is embodied by the second hand 51 pointing to markers 56 and city name information 57, and an indicator operator capable of moving the indicator is embodied by the crown 43 and button A 41 or button B 42 moving the second hand 51.

The controller 20, which is a location information setting device, sets the geographical information selected by the indicator operator as the location information corresponding to the time zone and daylight saving time rules.

Effect of Embodiment 2

In this electronic timepiece 1B, location information is set by moving the second hand 51 with the crown 43 or other indicator operator to point to specific geographical information, such as the markers 56 and city name information 57. Location information can therefore be set by a user operation even in a electronic timepiece 1B that does not have a positioning information satellite receiver. Based on the location information that is set, the controller 20 of the electronic timepiece 1B automatically determines the time zone, can automatically set the correct time when daylight saving time is implemented, and thereby improves user convenience.

An electronic timepiece 1B that is a world clock unable to acquire positioning information can also correct daylight saving time rules, and achieves the same effect as the first embodiment described above.

Furthermore, even when multiple countries share the same time zone set according to the city name information 57, and multiple daylight saving time rules are used in that time zone, the daylight saving time rules can be changed by setting DST On or DST Off by operating the button B 42, and user convenience can be improved. Furthermore, because changes in daylight saving time can be easily accommodated, the correct current local time can be displayed.

Embodiment 3

A third embodiment of the invention is described next.

The third embodiment of the invention adds to the electronic timepiece 1 of the first embodiment a manual configuration method enabling the user to manually set the daylight saving time rules when daylight saving time is introduced to a region where daylight saving time was previously not implemented. This manual method of configuring the daylight saving time rules when daylight saving time is introduced is described next with reference to FIG. 17. Note that identical steps in FIG. 17 and FIG. 7 related to the first embodiment are identified by the same reference numerals, and further description thereof is simplified or omitted.

When a location where daylight saving time is not implemented is selected, and the button B 42 is pushed, the controller 20 goes to a manual DST mode for manually setting the daylight saving time rules (step S1). When button B 42 is pushed, the controller 20 then determines whether or not the daylight saving time mode is on (step S2).

Operation when Changing to DST On

If the controller 20 determines NO in step S2, the controller 20 turns the DST mode On (setting daylight saving time in effect) (step S3). When the button B 42 is pushed the first time in a location where daylight saving time is not implemented, NO is thus returned in step S2, and in step S3 daylight saving time is turned on.

Next, the controller 20 determines if DST start data is stored in memory (step S21). Because there is no DST start data stored for a location where daylight saving time was not previously implemented, the controller 20 returns YES in step S21.

The controller 20 then determines if the current time (the time button B 42 was pushed) is within a valid DST start period (step S22).

A valid DST start period is a period in which daylight saving time may possibly start. For example, if the current location is in the northern hemisphere, daylight saving time normally starts in March or April. A valid period for starting daylight saving time may therefore be set from March to April (for example, from 00:00 on March 1 to 24:00 on April 30). If the current location is in the southern hemisphere, the valid DST start period may be similarly set to from September to October, for example.

If step S22 returns YES, that is, the timing of button B 42 operation is within the valid DST start period, the controller 20 sets the DST start data for the daylight saving time implementation period (step S23). In this event, because there is no original DST start data to modify, and the controller 20 sets the DST start to a predetermined default value. In this embodiment, for example, the controller 20 sets Sunday as the day of the week, 00:00 as the time, and the week when the button B 42 was pushed as the week, as the initial DST start data. In addition, because the DST time difference is normally one hour, the controller 20 sets the DST time difference to +1.

Next, the controller 20 determines if the DST end of the daylight saving time implementation period is already set (step S24). If step S24 returns YES, that is, both the DST start data and DST end data of the daylight saving time implementation period have already been set, the controller 20 determines that manual configuration of the daylight saving time implementation period was completed, and goes to the automatic DST mode (step S6).

Thereafter, as in the first embodiment, the controller 20 corrects the current local time based on the DST time difference (step S7), displays the corrected current local time with the hands 51, 52, 53, and indicates with the mode indicator 54 either DST On or DST Off (step S8).

If step S21 returns NO, step S22 returns NO, or step S24 returns NO, the controller 20 determines that the daylight saving time mode was manually changed from DST Off to DST On, and corrects the current local time by adding +1 hour (step S7).

The controller 20 then displays the corrected current local time with the hands 51, 52, 53, and indicates DST On with the mode indicator 54 (step S8).

Operation when Changing to DST Off

If the controller 20 determines YES in step S2, the controller 20 turns the DST mode Off (turns the daylight saving time mode off) (step S11). Therefore, after the button B 42 is pushed and daylight saving time turned on in step S3 in a region where daylight saving time was not previously implemented, step S2 returns YES when the button B 42 is then pushed again, and in step S11 daylight saving time is turned off.

Next, the controller 20 determines if DST end data is stored in memory (step S26). Because there is no DST end data stored fora location where daylight saving time was not implemented, the controller 20 returns YES in step S26.

The controller 20 then determines if the current time (the time button B 42 was pushed) is within a valid DST end period (step S27).

A valid DST end period is a period in which daylight saving time may possibly end. For example, if the current location is in the northern hemisphere, daylight saving time normally ends in October or November. A valid period for ending daylight saving time may therefore be set from October to November (for example, from 00:00 on October 1 to 24:00 on November 30). If the current location is in the southern hemisphere, the valid DST end period may be similarly set to from March to April, for example.

If step S27 returns YES, that is, the timing of button B 42 operation is within the valid DST end period, the controller 20 sets the DST end data for the daylight saving time implementation period (step S28). In this event, because there is no original DST end data to modify, the controller 20 sets the DST end to a predetermined default value. Similarly to setting the DST start value, in this embodiment the controller 20 sets Sunday as the day, 00:00 as the time, and the week when the button B 42 was pushed, as the initial DST end data.

Next, the controller 20 determines if the DST start data for the daylight saving time implementation period is already set (step S29). If step S29 returns YES, that is, both the DST start data and DST end data of the daylight saving time implementation period have been set, the controller 20 determines that manual configuration of the daylight saving time implementation period was completed. The controller 20 therefore sets the automatic DST mode (step S6), corrects the current local time by subtracting one hour (the DST time difference) from the current time (step S7), displays the corrected current local time with the hands 51, 52, 53, and indicates DST Off with the mode indicator 54 (step S8).

If step S26 returns NO, step S27 returns NO, or step S29 returns NO, the controller 20 determines that the daylight saving time mode was manually changed from DST On to DST Off, and corrects the current local time by subtracting one hour (the DST time difference) (step S7).

The controller 20 displays the corrected current local time with the hands 51, 52, 53, and indicates DST On with the mode indicator 54 (step S8).

Effect of Embodiment 3

This third embodiment of the invention has the same effect as the first embodiment.

In addition, when configuring a new daylight saving time rule for a time zone in which daylight saving time is not implemented, this embodiment of the invention determines if the current time is in a period that is valid as a time to start or a time to end daylight saving time, and, only if the current time is valid, creates a daylight saving time rule based on the month and week when the operator was pushed, and a predetermined default day and hour. This prevents creating a daylight saving time rule when the button B 42 (operator) is operated at the wrong time. Therefore, because the controller 20 executes a rule setting process when the probability is high that the user operated the button B 42 to set a daylight saving time rule, a correct daylight saving time rule can be defined.

Embodiment 4

Figure 19:
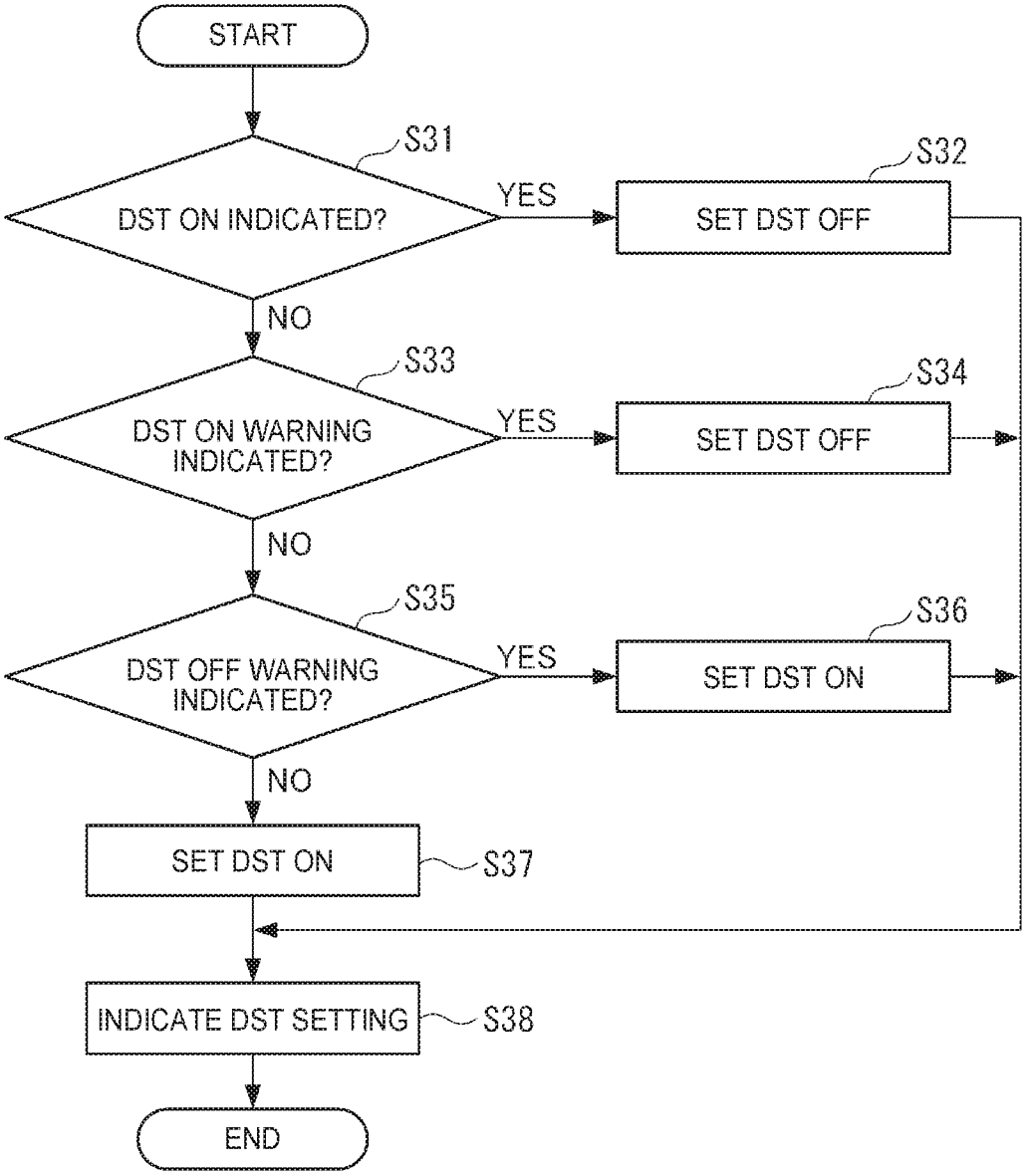
FIG. 19 is a flow chart of the process executed when button B is pressed in the fourth embodiment of the invention.
Figure 20:
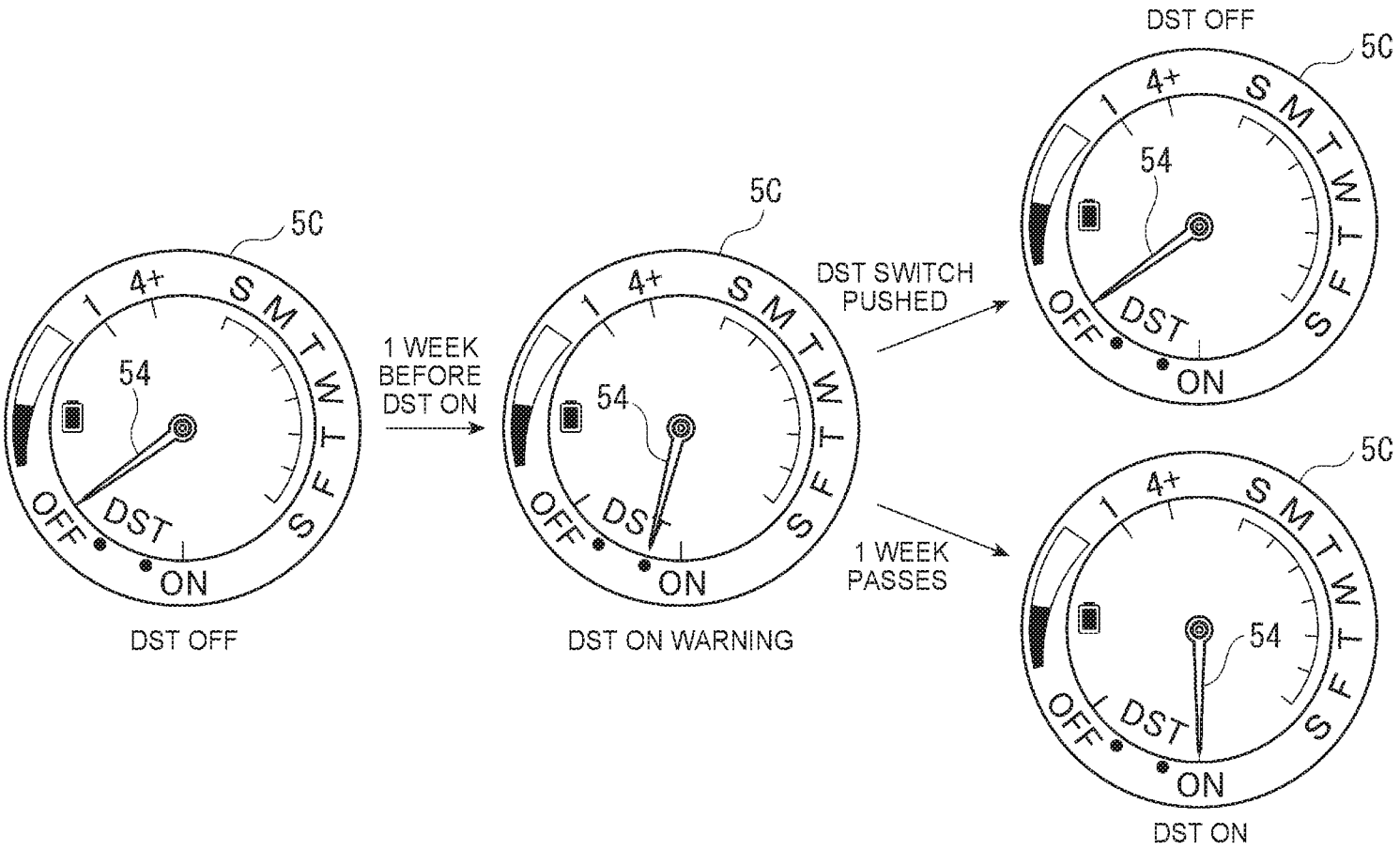
FIG. 20 illustrates operation of the indicator hand in the fourth embodiment of the invention.

A fourth embodiment of the invention is described next with reference to FIG. 18 to FIG. 20. Like parts in an electronic timepiece 1C according to the fourth embodiment of the invention and the electronic timepiece 1 according to the first embodiment of the invention are identified by like reference numerals, and further description thereof is omitted.

This electronic timepiece 1C differs from the first embodiment in providing a DST On warning display period during the DST Off period, and a DST Off warning display period during the DST On period.

Figure 18:
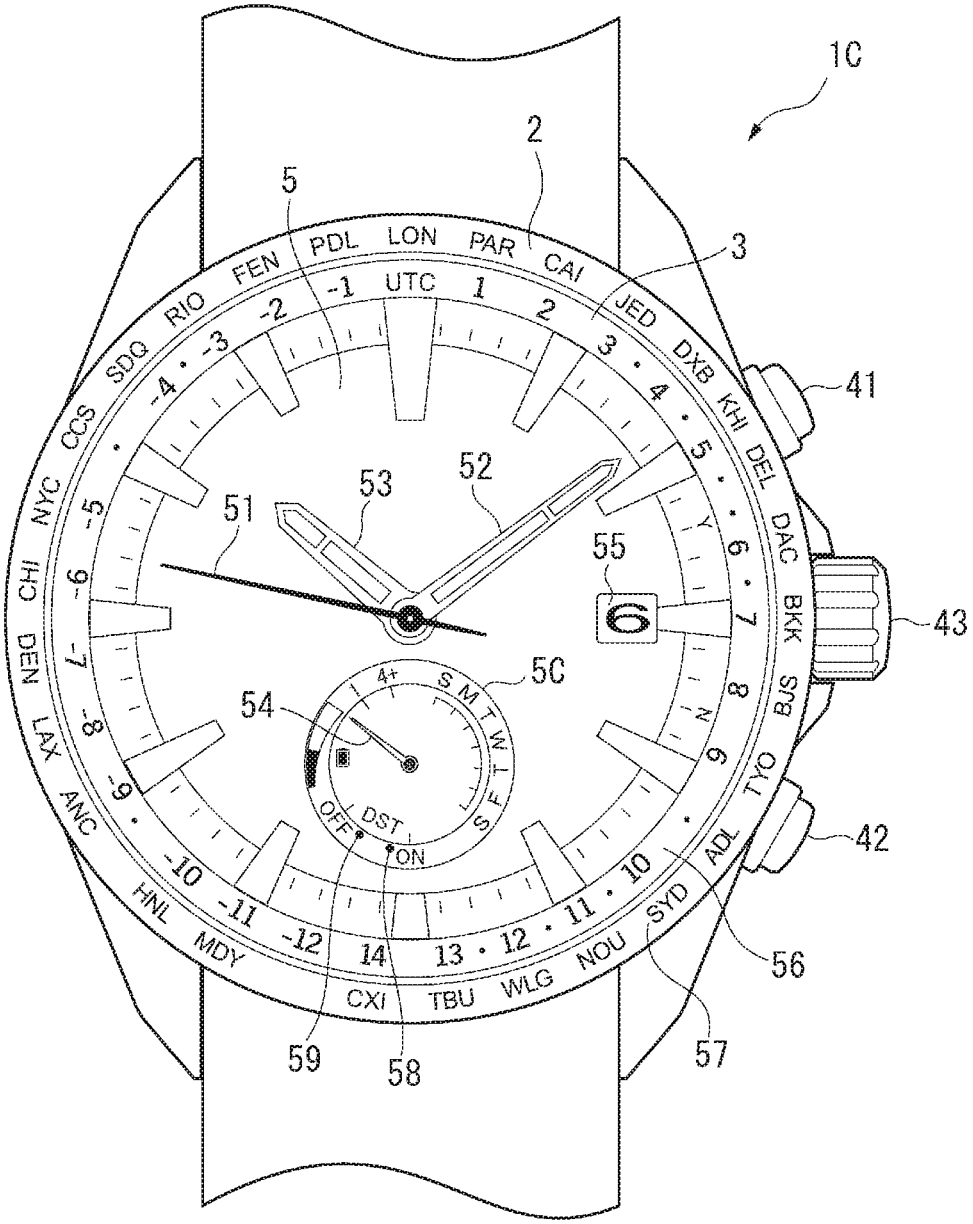
FIG. 18 is a plan view of an electronic timepiece according to a fourth embodiment of the invention.

As a result, as shown in FIG. 18, a bullet marker 58 for indicating daylight saving time will soon turn on, and a bullet marker 59 for indicating daylight saving time will soon turn off, are provided between the DST On and DST Off markers in the subdial 5C of the electronic timepiece 1C.

When in the automatic DST mode and the time reaches a specific time (such as one week) before the start of daylight saving time, the controller 20 of the electronic timepiece 1C moves the mode indicator 54 from the DST Off marker to the bullet marker 59 indicating that daylight saving time will soon start (DST On).

When in the automatic DST mode and the time reaches a specific time (such as one week) before the end of daylight saving time, the controller 20 of the electronic timepiece 1C moves the mode indicator 54 from the DST On marker to the bullet marker 58 indicating that daylight saving time will soon end (DST Off).

A warning indicator displaying, for a specific time before daylight saving time starts and ends, that a change in daylight saving time is approaching is thus embodied by the bullet markers 58, 59, and mode indicator 54 of the subdial 5C.

Control by the controller 20 when the button B 42 is pushed is described next with reference to FIG. 19.

When the button B 42 is pushed, the controller 20 sequentially determines if DST On is indicated (step S31), if the DST On warning is indicated (step S33), or if the DST Off warning is indicated (step S35).

If DST On is indicated (step S31: YES), the controller 20 switches to DST Off (step S32).

If the DST On warning is indicated (step S33: YES), the controller 20 switches to DST Off (step S34).

If the DST Off warning is indicated (step S35: YES), the controller 20 switches to DST On (step S36).

If step S31, S33, and S35 return NO, the controller 20 determines DST Off is indicated, and switches to DST On (step S37).

After changing to DST Off or DST On in step S32, S34, S36, or S37, the controller 20 indicates the current setting (DST Off or DST On) with the mode indicator 54 (step S38).

Control after Indicating the DST on Warning

Control after the DST On warning is indicated is described next with reference to FIG. 20 and FIG. 21.

As described above, the controller 20 moves the mode indicator 54 from the DST Off marker to the DST On warning marker one week before starting daylight saving time from the DST Off state.

Figure 21:
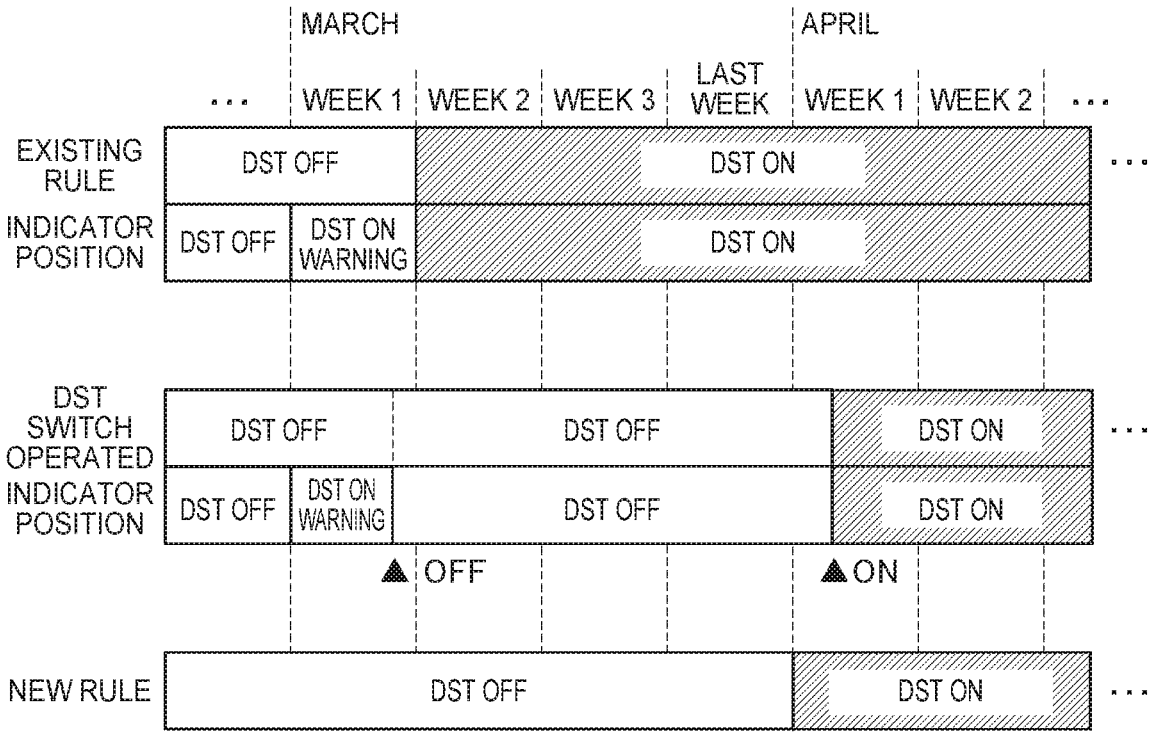
FIG. 21 illustrates an example of correcting the daylight saving time period in the fourth embodiment of the invention.

If the user pushes the button B 42, which is the DST mode switch, while the DST On warning is indicated, the daylight saving time mode is set to DST Off, and the mode indicator 54 moves to the DST Off marker, as shown in FIG. 21. This switching operation cancels the DST On state, and the controller 20 holds the DST Off state even the DST start time is reached.

As shown in FIG. 21, if the button B 42 is then pushed while the DST Off state is held, the controller 20 changes to DST On. As in the first embodiment, the DST start data is corrected if the button B 42 is pushed within a specific period (such as one month) from the DST start time.

If one week passes without the button B 42 being pushed while the DST On warning is indicated, and the current time reaches the DST start time, the controller 20 automatically changes to the DST On mode. As a result, as shown in FIG. 20, the controller 20 moves the mode indicator 54 to the DST On marker, corrects the current local time based on the DST time difference, and then indicates the corrected current local time with the hands 51, 52, 53.

Control after Indicating the DST Off Warning

Figure 22:
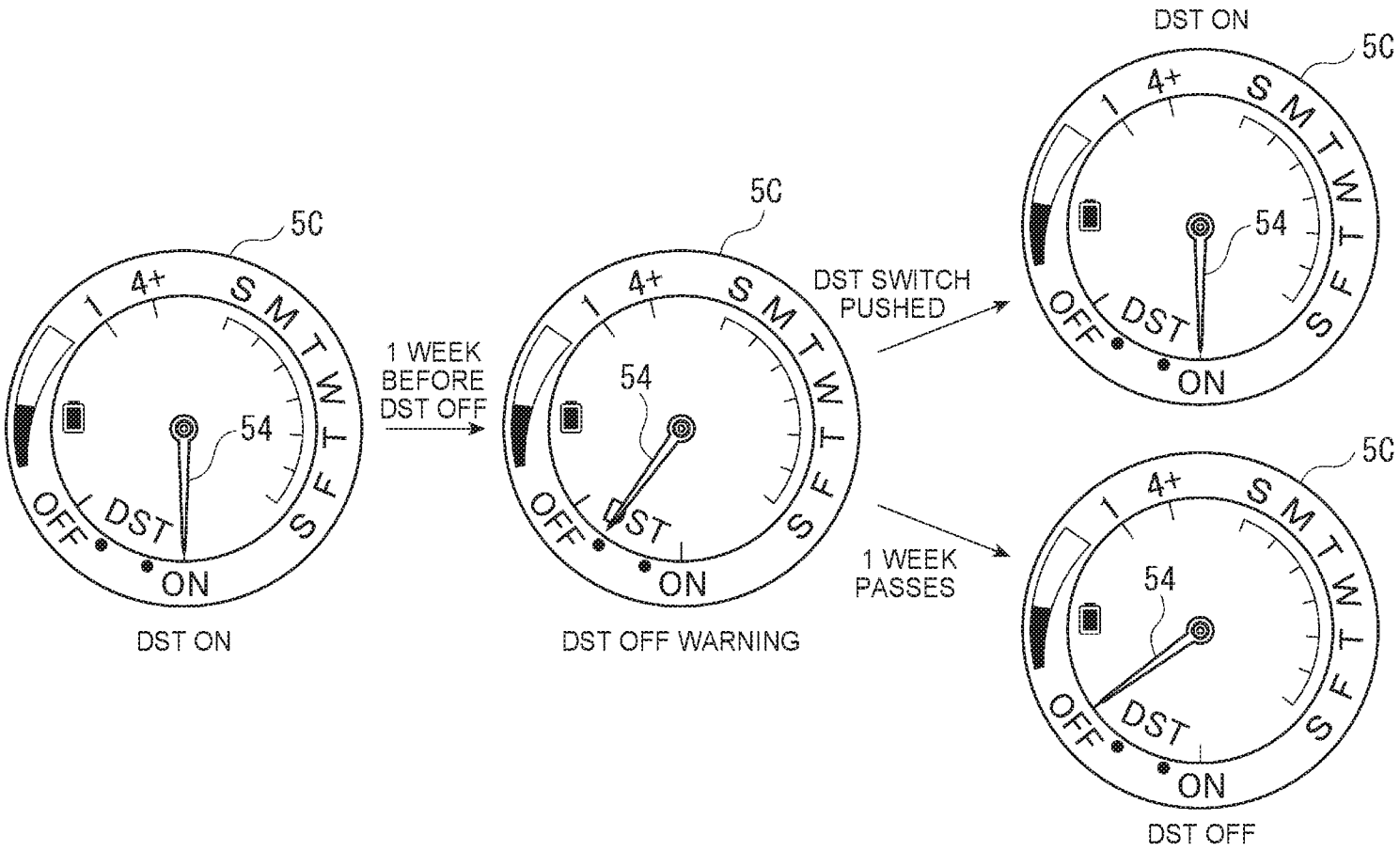
FIG. 22 illustrates operation of the indicator hand in the fourth embodiment of the invention.

Control after the DST Off warning is indicated is described next with reference to FIG. 22 and FIG. 23.

As described above, the controller 20 moves the mode indicator 54 from the DST On marker to the DST Off warning marker one week before ending daylight saving time from the DST On state.

Figure 23:
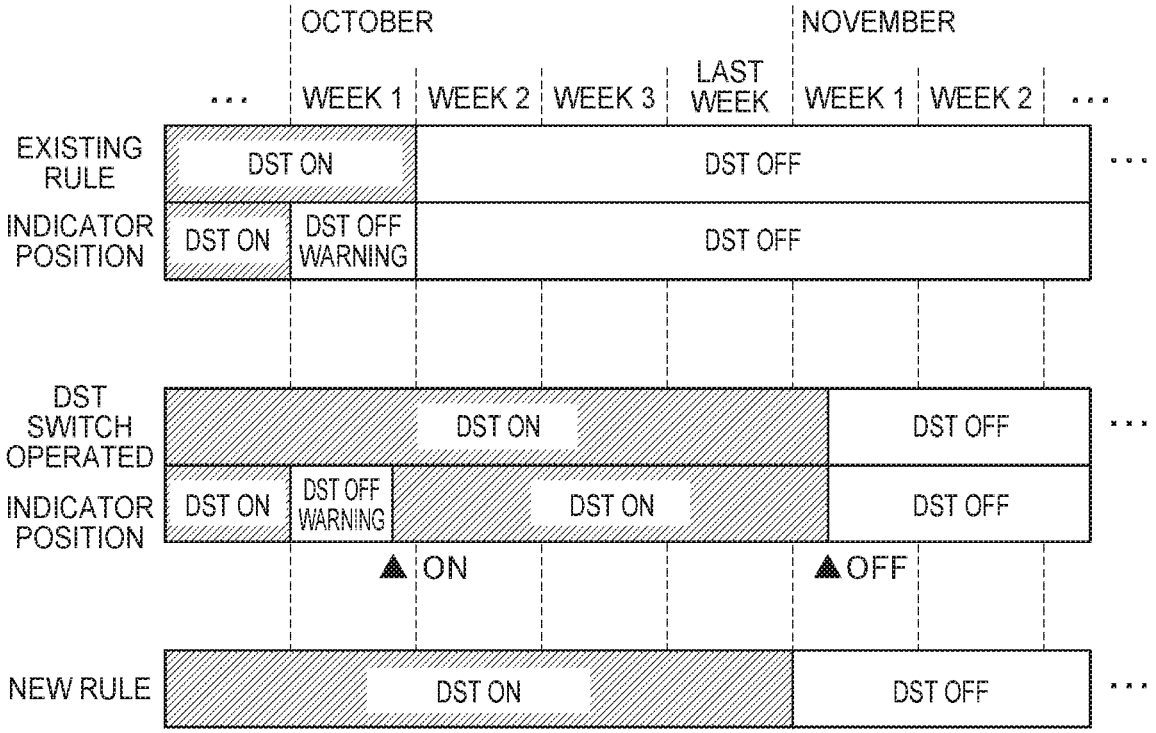
FIG. 23 illustrates an example of correcting the daylight saving time period in the fourth embodiment of the invention.

If the user pushes the button B 42, which is the DST mode switch, while the DST Off warning is indicated, the daylight saving time mode is set to DST On, and the mode indicator 54 moves to the DST On marker, as shown in FIG. 23. This switching operation cancels the DST Off state, and the controller 20 holds the DST On state even the DST end time is reached.

As shown in FIG. 23, if the button B 42 is then pushed while the DST On state is held, the controller 20 changes to DST Off. As in the first embodiment, the DST end data is corrected if the button B 42 is pushed within a specific period (such as one month) from the DST end time.

If one week passes without the button B 42 being pushed while the DST Off warning is indicated, and the current time reaches the DST end time, the controller 20 automatically changes to the DST Off mode. As a result, as shown in FIG. 22, the controller 20 moves the mode indicator 54 to the DST Off marker, corrects the current local time by subtracting the DST time difference, and then indicates the corrected current local time with the hands 51, 52, 53.

Effect of Embodiment 4

The electronic timepiece 1C according to the fourth embodiment of the invention has the same effect as the embodiments described above.

In addition, by providing a warning display that indicates a change in daylight saving time is approaching with markers 58, 59 on the subdial 5C, the user can be provided in advance with an opportunity to change the daylight saving time rules. As a result, user convenience can be improved and the accurate current local time can be displayed.

Furthermore, because the manual DST mode can be selected by operating the button B 42 while an approaching change in daylight saving time is indicated, turning the daylight saving time mode on or off automatically based on the daylight saving time rules can be prevented. As a result, when the daylight saving time rule has changed, automatically applying the old rule can be prevented, the daylight saving time mode switching at the wrong time based on a rule different from the new rule can be prevented, and the accurate current local time can be displayed.

Other Examples

The invention is not limited to the embodiments described above, and can be modified and improved in many ways without departing from the scope of the accompanying claims.

For example, a confirmation mode that uses the hands 51 to 54 and calendar wheel 55 to display the daylight saving time rule after being changed or set may also be provided. For example, after a daylight saving time rule is manually changed and the confirmation mode is selected by operating a specific button, the mode indicator 54 could move to the DST On marker to inform the user the DST start data of the daylight saving time implementation period will be displayed, and the calendar wheel 55 then moving between 1 and 12 to indicate the month of the DST start, the second hand 51 moving to indicate the week, and the mode indicator 54 moving to indicate the day. The week of the DST start, for example, may be indicated by the second hand 51 moving to the 1:00 hour marker to indicate week 1, and moving to the appropriate 2:00 to 5:00 hour marker to indicate weeks 2 to 5. The time of the DST start may be indicated by the hour hand 53 and minute hand 52, for example.

When the specific button is operated again, the mode indicator 54 may move to the DST Off marker to inform the user the DST end data of the daylight saving time implementation period will be displayed, and the calendar wheel 55, second hand 51, and mode indicator 54 then moving to indicate the month, week, and day of the DST end in the same way as when indicating the DST start data. The time of the DST end may also be indicated by the hour hand 53 and minute hand 52.

By displaying the daylight saving time rule as modified, the user can confirm if the rule is set correctly, reset the rule if set incorrectly, and thereby correctly display the current local time.

In addition to the time zone setting table 81, 81B, and daylight saving time rule table 82, 82B, the foregoing embodiments also store a time zone setting correction table 83, 83B, but the time zone setting correction table 83, 83B may be omitted and the time zone setting table 81, 81B modified directly.

For example, when the time zone setting table 81B relates a DST number to the city number or city name and time zone as in the second embodiment, there are few data sets and there is no need to compress the data for storage. As a result, the controller 20 can directly modify the DST numbers in the time zone setting table 81B, eliminating the need to maintain a time zone setting correction table 83B.

Furthermore, when the data structure of the time zone setting table 81, 81B is configured so that the DST number can be corrected for a specific region, there is also no need to provide a time zone setting correction table 83, 83B.

Figure 7:
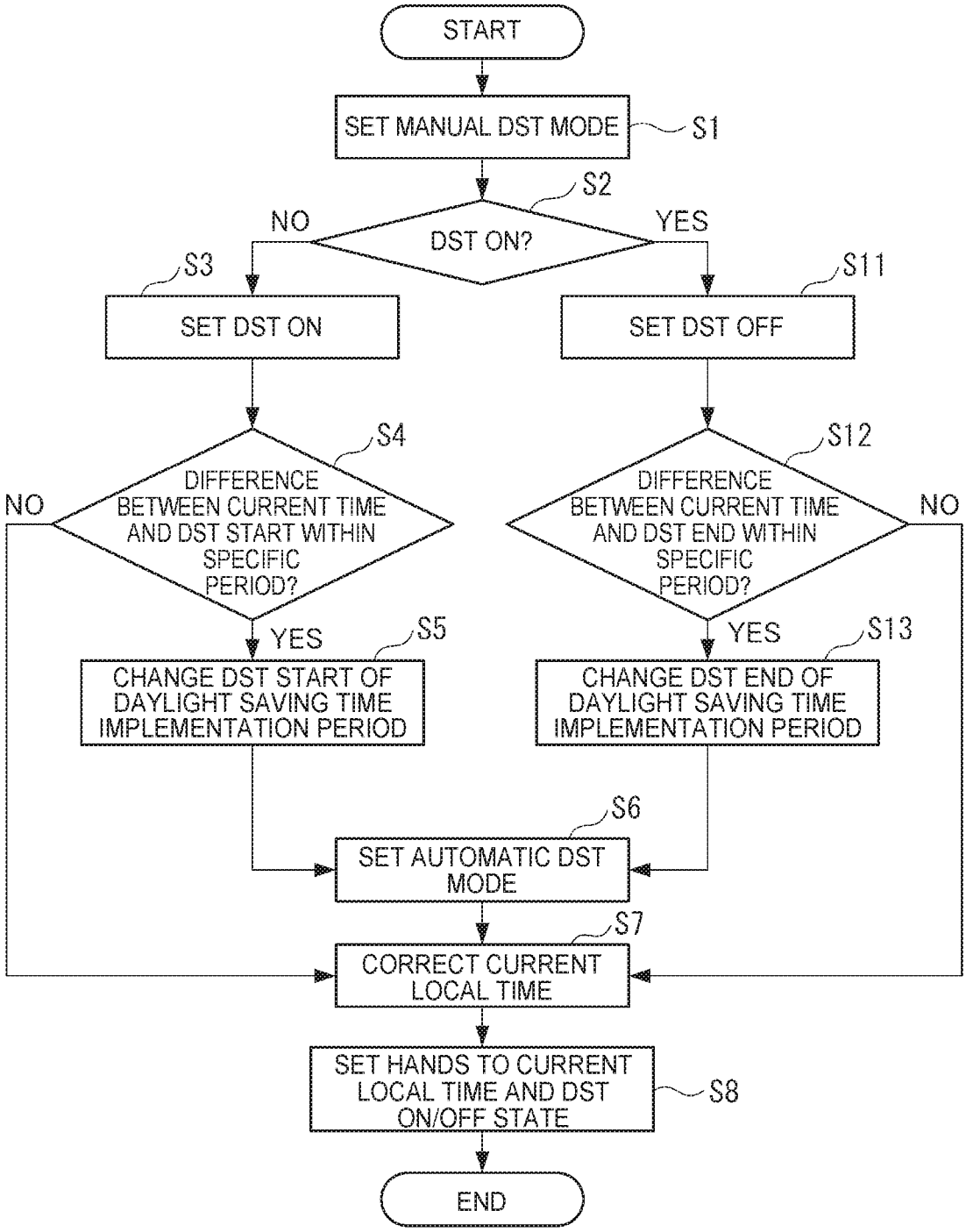
FIG. 7 is a flow chart of a process for manually adjusting the start and end of daylight saving time in the first embodiment of the invention.
Figure 17:
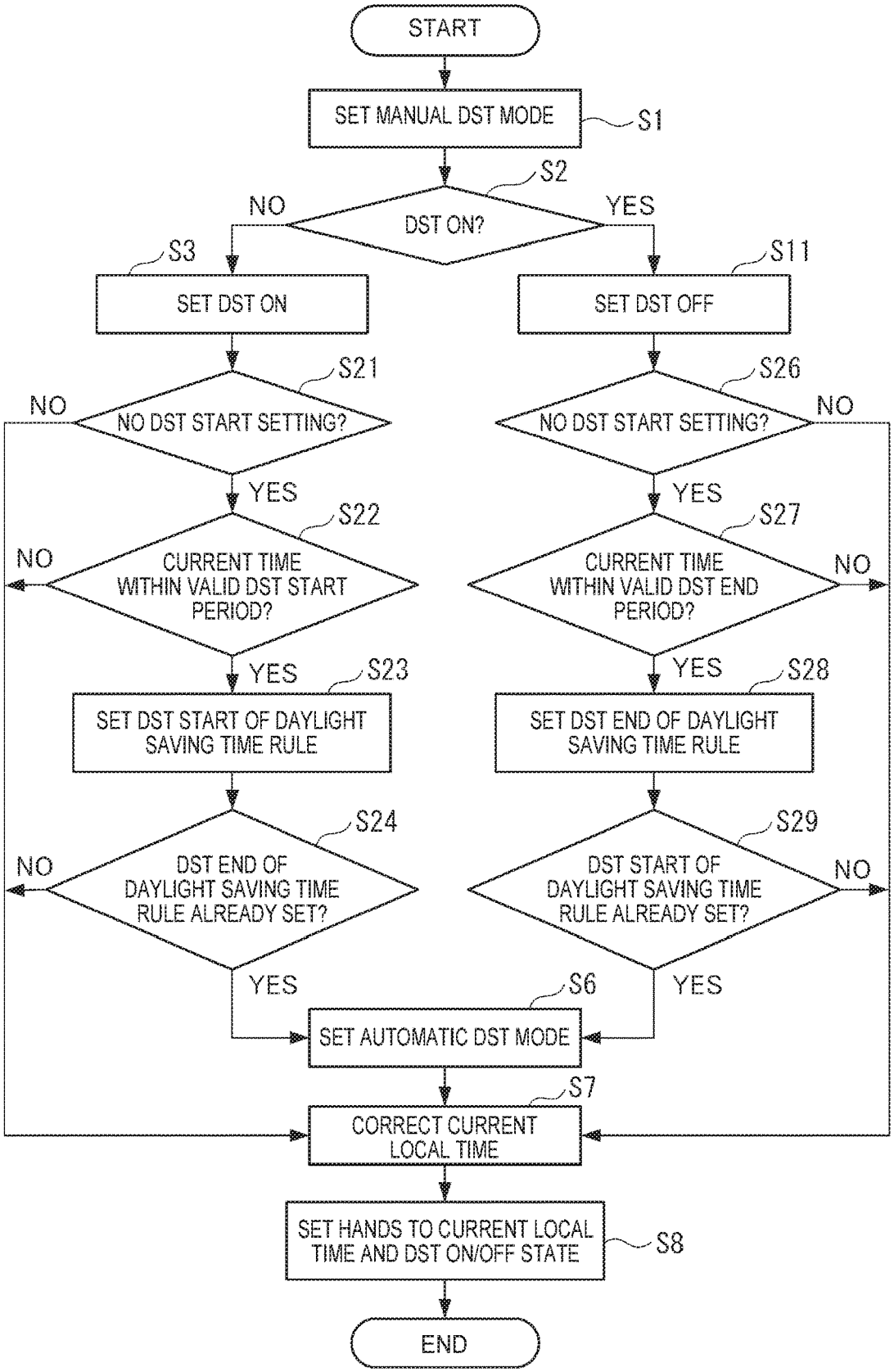
FIG. 17 is a flow chart of a process for manually adjusting the start and end of daylight saving time in a third embodiment of the invention.

Further alternatively, the decision steps S24 and S29 in FIG. 17 for the third embodiment may be added after steps S5 and S13 in the flow chart of the first embodiment in FIG. 7 to set the automatic DST mode when both the DST start and DST end data of a daylight saving time implementation period are changed.

The automatic DST mode is set when a daylight saving time rule is changed in each of the embodiments described above, but the manual DST mode may be maintained, and the automatic DST mode set when the user performs a specific operation to select the automatic DST mode.

In the third embodiment described above, the daylight saving time rule is set to predetermined default values. Alternatively, the data table could be searched for daylight saving time rules for nearby regions matching the timing when DST On and DST Off are set with the button B 42, and if a matching rule is found, that rule could be applied. For example, if the current location acquired by the positioning information satellite receiver 10 is in a region near a national border, daylight saving time may not be implemented in that location. In this case, because the month and week of the DST start and DST end are determined based on when the button B 42 was operated, if there is a rule with the same month and week found in the daylight saving time rules for a nearby region, that rule may be applied. In this case, the daylight saving time rule may beset by the operation setting only the DST start or the DST end, and user convenience can be improved.

Only the button B 42 is used as the DST switch in the foregoing embodiments, but the DST switch may comprise two buttons, one for setting DST On, and one for setting DST Off, for example.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-041891, filed Mar. 6, 2017 is expressly incorporated by reference herein.

What is claimed is:

1. An electronic timepiece comprising:

a memory storing location information, time zones corresponding to the location information, and daylight saving time rules corresponding to the location information;

a location information setting device configured to set the location information;

a time display configured to display time based on the time zone and the daylight saving time rule corresponding to the location information set by the location information setting device;

a daylight saving time switch configured to switch between a daylight saving time on state and a daylight saving time off state; and a controller configured to correct the daylight saving time rule based on whether the daylight saving time switch was operated to switch between the daylight saving time on and off states within a predetermined time period from the daylight saving time rule, wherein the daylight saving time rule includes data indicating the start time and end time of the daylight saving time implementation period, when the daylight saving time state is changed from off to on by the daylight saving time switch, the controller changes the start time data of the daylight saving time implementation period based on the timing of daylight saving time switch operation if the timing of daylight saving time switch operation is within a predetermined time period from the start time of the existing daylight saving time rule, and when the daylight saving time state is changed from on to off by the daylight saving time switch, the controller changes the end time data of the daylight saving time implementation period based on the timing of daylight saving time switch operation if the timing of daylight saving time switch operation is within a predetermined time period from the end time of the existing daylight saving time rule.

2. The electronic timepiece described in claim 1, wherein:

the controller, when the start time or end time of the daylight saving time rule to be corrected is defined by the month, week, day, and time, changes the month and week to the month and week of the timing when the daylight saving time switch was operated, and does not change the day and time.

3. The electronic timepiece described in claim 1, wherein:

the controller, when the start time or end time of the daylight saving time rule to be corrected is defined by a specific date and time, changes the date to the date of the timing when the daylight saving time switch was operated, and does not change the time.

4. The electronic timepiece described in claim 1, wherein:

when the daylight saving time implementation period to be corrected is not defined, and when the daylight saving time state is changed from off to on by the daylight saving time switch, the controller determines if the timing of the daylight saving time switch operation is within a period that is valid as the start time of the daylight saving time implementation period, and if the timing is within a valid period, the controller sets the month and week of the timing of the daylight saving time switch operation and a previously set day and time as the start time of the daylight saving time implementation period; and when the daylight saving time state is changed from on to off by the daylight saving time switch, the controller determines if the timing of the daylight saving time switch operation is within a period that is valid as the end time of the daylight saving time implementation period, and if the timing is within a valid period, the controller sets the month and week of the timing of the daylight saving time switch operation and a previously set day and time as the end time of the daylight saving time implementation period.

5. The electronic timepiece described in claim 1, further comprising:

a positioning information satellite receiver configured to receive satellite signals transmitted from positioning information satellites, and acquire current location and time information;

the location information setting device setting the location information based on the current location acquired by the positioning information satellite receiver.

6. The electronic timepiece described in claim 1, wherein:

the location information setting device includes a geographical information display on which is displayed geographical information identifying location information, a hand capable of indicating the geographical information, and a hand operator capable of moving the hand;

the location information setting device setting the location information based on the geographical information indicated by the hand moved by the hand operator.

7. The electronic timepiece described in claim 1, wherein:

the controller is configured to execute an automatic daylight saving time mode automatically applying daylight saving time according to the daylight saving time rule, and a manual daylight saving time mode applying or not applying daylight saving time according to operation of the daylight saving time switch, and setting the automatic daylight saving time mode when a daylight saving time rule is corrected by operation of the daylight saving time switch.

8. The electronic timepiece described in claim 1, further comprising:

a warning display configured to display, when in the automatic daylight saving time mode, the approach of a change in daylight saving time a predetermined time period before the start and end of daylight saving time;

the controller being configured to execute an automatic daylight saving time mode automatically applying daylight saving time according to the daylight saving time rule, and a manual daylight saving time mode applying or not applying daylight saving time according to operation of the daylight saving time switch; and switching from the automatic daylight saving time mode to the manual daylight saving time mode when the daylight saving time switch is operated while the approach of a change in daylight saving time is displayed by the warning display.

9. The electronic timepiece described in claim 1, further comprising:

a daylight saving time change display configured to display change in the daylight saving time mode for a predetermined time period after daylight saving time starts and after daylight saving time ends.

* * * * *